US008184826B2

(12) United States Patent
Matsumura et al.

(10) Patent No.: US 8,184,826 B2
(45) Date of Patent: May 22, 2012

(54) SPEAKER SYSTEM

(75) Inventors: Toshiyuki Matsumura, Osaka (JP); Shuji Saiki, Nara (JP)

(73) Assignee: Panasonic Corporation, Osaka (JP)

( * ) Notice: Subject to any disclaimer, the term of this patent is extended or adjusted under 35 U.S.C. 154(b) by 984 days.

(21) Appl. No.: 12/171,489

(22) Filed: Jul. 11, 2008

(65) Prior Publication Data

US 2009/0028370 A1 Jan. 29, 2009

(30) Foreign Application Priority Data

Jul. 27, 2007 (JP) ..... 2007-195380

(51) Int. Cl.
*H04R 1/02* (2006.01)
*A47B 81/06* (2006.01)

(52) U.S. Cl. ..... 381/89; 381/332; 381/345; 381/349; 381/386; 381/389; 181/149; 181/199

(58) Field of Classification Search ..... 381/386–388, 381/345, 349, 89, 332, 98, 389; 181/196–199, 181/149
See application file for complete search history.

(56) References Cited

U.S. PATENT DOCUMENTS

| | | | | |
|---|---|---|---|---|
| 4,657,108 | A * | 4/1987 | Ward | 181/151 |
| 5,056,616 | A * | 10/1991 | Astrom | 181/156 |
| 5,150,417 | A * | 9/1992 | Stahl | 381/349 |
| 2007/0147645 | A1 * | 6/2007 | Kuze et al. | 381/337 |

FOREIGN PATENT DOCUMENTS

| | | |
|---|---|---|
| JP | 60-500645 | 5/1985 |
| WO | 84/03600 | 9/1984 |

* cited by examiner

*Primary Examiner* — Michael Trinh
(74) *Attorney, Agent, or Firm* — Wenderoth, Lind & Ponack, L.L.P.

(57) ABSTRACT

A speaker system includes a cabinet, at least one speaker unit fixed to the cabinet, and a gas adsorbent which is situated inside the cabinet and which is made from a porous material. The speaker unit is configured with moisture-proof component parts. In the speaker system, a tubular structure which has a tubular hollow allows ventilation between an inside and an outside of the cabinet. A resonant frequency which is determined by an acoustic impedance of the tubular structure and an acoustic impedance of the cabinet is lower than a minimum resonant frequency of an acoustic impedance of the speaker system.

7 Claims, 32 Drawing Sheets

SPEAKER SYSTEM

BACKGROUND OF THE INVENTION

1. Field of the Invention

The present invention relates to a speaker system, and more particularly relates to a speaker system which is capable of expanding a cabinet capacity by using a gas adsorbent made from a porous material and which is capable of improving performance in a bass sound reproduction.

2. Description of the Background Art

In a conventional speaker system, due to an effect of an acoustic stiffness caused by an internal cavity of a cabinet, it has been difficult to realize a speaker system which is small and which is capable of reproducing a bass sound. As a solution to solve limits of the bass sound reproduction, which are determined by the capacity of the internal cavity of the cabinet, a speaker system which has an aggregate of activated carbon situated inside the cabinet has been suggested (e.g., Japanese National Phase PCT Laid-Open Publication No. 60-500645). FIG. 34 is a tectonic profile of a conventional speaker system disclosed in Japanese National Phase PCT Laid-Open Publication No. 60-500645.

As shown in FIG. 34, the conventional speaker system includes a cabinet 1, a speaker unit 2, a gas adsorbent 3, a supporting material 4, a diaphragm 5 and a bent tube 6. The speaker unit 2 is fixed to the cabinet 1. The gas adsorbent 3 is made from a porous material which is capable of adsorbing/desorbing air molecules, and is situated inside the cabinet 1. In FIG. 34, the gas adsorbent 3 is composed by aggregating granular activated carbon, which is the porous material. The supporting material 4 is provided inside the cabinet 1 so as to support the gas adsorbent 3. The entire surface of the supporting material 4 has pores formed thereon so as to allow the air to pass through. The diaphragm 5 is provided inside the cabinet 1 so as to divide the internal cavity of the cabinet 1 into R1 and R2. The bent tube 6 is fixed to the diaphragm 5 so as to allow ventilation between the internal cavity R1 and the internal cavity R2.

An operation of the speaker system configured as above will be described. When an acoustic signal is applied to the speaker unit 2, the diaphragm of the speaker unit 2 vibrates, and an air pressure of the internal cavity R1 changes. Due to this change in the air pressure, the diaphragm 5 vibrates. The supporting material 4 has pores on the entire surface thereof, and thus the air pressure of the entire internal cavity R2 changes due to the vibration of the diaphragm 5. The gas adsorbent 3 adsorbs/desorbs ambient air molecules in accordance with the change in the air pressure of the internal cavity R2. Due to the adsorption/desorption action, the change in the air pressure of the internal cavity R2 is reduced, and the change in the air pressure of the internal cavity R1 is also reduced. In this manner, the change in the air pressure of the entire internal cavity of the cabinet 1 is reduced, and accordingly the cabinet 1 operates as if having a large capacity in an equivalent manner. Accordingly, the conventional speaker system, which has a small cabinet, has been capable of operating as if a speaker unit is fixed to a cabinet having a large capacity, and also capable of realizing a bass sound reproduction.

However, moisture outside the cabinet 1 flows inside the cabinet through the diaphragm and an edge of the speaker unit. When an ambient humidity is high, the gas adsorbent 3 adsorbs moisture in the air, and consequently, the adsorption/desorption action of the gas adsorbent 3 deteriorates. Therefore, a cabinet capacity expansion effect, as above described, decreases. Accordingly, in Japanese National Phase PCT Laid-Open Publication No. 60-500645, the diaphragm 5 is provided so as to prevent the moisture from flowing into the internal cavity R2 from the outside of the cabinet 1.

However, when a temperature around the speaker system increases, or when an atmospheric pressure around the speaker system decreases, the air confined in the internal cavity R2 inflates, and the air molecules adsorbed by the gas adsorbent 3 are discharged therefrom. Therefore, when the internal cavity R2 is completely sealed by the diaphragm 5, the diaphragm 5 is displaced toward a front side of the speaker system. When the diaphragm 5 is displaced toward the front side of the speaker system, the vibration of the diaphragm 5 is disturbed, and the cabinet capacity expansion effect caused by the gas adsorbent 3 decreases. Further, the diaphragm 5 is likely to be broken. The problem like this may also occur when the temperature around the speaker system decreases or when an atmospheric pressure around the speaker system increases.

Therefore, in Japanese National Phase PCT Laid-Open Publication No. 60-500645, the bent tube 6 is provided to the diaphragm 5. When the air in the internal cavity R2 inflates/deflates, the air moves inside the bent tube 6 in accordance with the inflation/deflation. Accordingly, since an increase/decrease in the air in the internal cavity R2 is suppressed, it is possible to prevent the decrease in the cabinet capacity expansion effect caused by the gas adsorbent 3 and also possible to prevent breaking of the diaphragm 5.

Further, in Japanese National Phase PCT Laid-Open Publication No. 60-500645, powdery activated carbon (not shown) of 0.05 mm diameter is filled in the bent tube 6. The powdery activated carbon is filled in order to prevent the air from flowing through the bent tube 6 in a frequency band in which the speaker unit 2 operates, and also to minimize moisture flowing into the internal cavity R2 from the outside of the cabinet 1.

However, it is generally difficult to handle the powdery activated carbon which is filled in the bent tube 6, since fluidity of the powdery activated carbon needs to be maintained, and since the powdery activated carbon tends to cause static electricity. It is also extremely difficult to stably fill the powdery activated carbon into a narrow tube such as the bent tube 6. Disclosed in Japanese National Phase PCT Laid-Open Publication No. 60-500645 is that the powdery activated carbon having a diameter of 0.05 [mm] is filled in the bent tube 6 having a diameter of 8 [mm] and a length of about 60 [cm]. However, it is extremely difficult to realize the situation. In other words, it is substantially impossible for the conventional speaker system disclosed in the Japanese National Phase PCT Laid-Open Publication No. 60-500645 to minimize the moisture flowing into the internal cavity R2 from the outside of the cabinet 1.

SUMMARY OF THE INVENTION

Therefore, an object of the present invention is to provide a speaker system which is capable of minimizing the moisture flowing from the outside of the cabinet into the inside of the cabinet which has a gas adsorbent situated there inside.

The present invention has the following features to attain the object mentioned above. The speaker system according to the present invention includes a cabinet, at least one speaker unit fixed to the cabinet, and a gas adsorbent which is situated inside the cabinet and which is made from a porous material. The speaker unit is configured with moisture-proof component parts. A tubular structure which has a tubular hollow for allowing ventilation between an inside and an outside of the cabinet is provided in the speaker system. A resonant frequency which is determined by an acoustic impedance of the tubular structure and an acoustic impedance of the cabinet is lower than a minimum resonant frequency of an acoustic impedance of the speaker system.

According to the present invention, the resonant frequency which is determined by the acoustic impedance of the tubular structure and the acoustic impedance of the cabinet is lower than the minimum resonant frequency of the acoustic impedance of the speaker system. Accordingly, with respect to slow changes such as a change in a temperature or an atmospheric pressure around the speaker system, it is possible to move the air from the inside to the outside (or, from the outside to the inside) of the cabinet through the tubular hollow. On the other hand, with respect to significantly rapid changes such as a change in a pressure in a frequency band in which the speaker unit operates, it is possible to significantly suppress the movement of the air from the inside to the outside (or from the outside to the inside) of the cabinet through the tubular hollow. Further, the speaker unit is configured with moisture-proof component parts. With such configuration, according to the present invention, it is possible to minimize the moisture flowing from the outside to the inside of the cabinet which has the gas adsorbent situated thereinside.

Preferably, the tubular structure is configured with a tubular material which is fixed to the cabinet and which has a tubular hollow. In this case, speaker system may further include cooling means for cooling the tubular material. Alternatively, a heating component, which is included in an exterior device, may be situated in the vicinity of the speaker system, and the tubular material may be fixed to the cabinet so as to be in contact with the heating component.

Still preferably, the tubular structure may be configured with: the cabinet which has a first through-hole formed extending from the inside to the outside of the cabinet; and a planar material which has a first channel and a second through-hole situated at one extremity of the first channel and which is fixed to the cabinet such that the other extremity of the first channel is connected to the first through-hole and so as to cover the first channel. The tubular hollow may be formed by the first through-hole, the first channel and the second through-hole. In this case, the planar material may have a second channel formed on a surface thereof facing the cabinet at a position different from that of the first channel. Alternatively, the cabinet may have a second channel formed on a surface thereof facing the planar material at a position so as not to directly face the first channel.

Still preferably, the tubular structure is configured with: the cabinet which has a first channel and a first through-hole which is situated at one extremity of the first channel so as to extend from the inside to the outside of the cabinet; and a planar material which has a second through-hole and which is fixed to the cabinet such that the second through-hole is connected to the other extremity of the first channel and so as to cover the first channel. The tubular hollow may be formed by the first through-hole, the first channel and the second through-hole. In this case, the planar material may have a second channel formed on a surface thereof facing the cabinet at a position so as not to directly face the first channel. Alternatively, the cabinet may have a second channel formed on a surface thereof facing the planar material at a position different from that of the first channel.

Still preferably, the tubular structure is configured with: the cabinet which has a first through-hole formed extending from the inside to the outside of the cabinet; a first planar material which has a second through-hole and which is fixed to the cabinet such that the second through-hole is connected to the first through-hole; an elastic material which has a third through-hole having narrow openings and which is fixed to the first planar material such that the second through-hole is connected to one extremity of the third through-hole and so as to cover one of the openings of the third through-hole; and a second planar material which has a fourth through-hole and which is fixed to the elastic material such that the fourth through-hole is connected to the other extremity of the third through-hole and so as to cover the other opening of the third through-hole. The tubular hollow may be formed by the first to fourth through-holes. In this case, the second planar material may be firmly fixed to the first planar material so as to sandwich and compress the elastic material together with the first planar material.

Still preferably, the tubular structure is configured with: a screw; and the cabinet having a through-hole into which the screw is inserted and whose inner surface has grooves whose depth is deeper than a height of screw threads of the screw. The tubular hollow may be formed between the screw threads of the screw and the grooves.

Still preferably, the tubular structure is configured with a screw which is inserted into the cabinet such that an end thereof reaches an internal cavity of the cabinet, which has a tubular hollow formed from a head to the end thereof.

Still preferably, the tubular structure is configured with the cabinet in which the tubular hollow is formed.

Still preferably, the tubular structure is configured with: the speaker unit; and the cabinet having a channel formed at a position in contact with the speaker unit. The tubular hollow may be formed between the speaker unit and the channel.

Still preferably, the tubular structure is configured with: the cabinet; and the speaker unit having a channel formed at a position in contact with the cabinet. The tubular hollow may be formed between the cabinet and the channel.

Still preferably, the tubular structure is configured with a drone cone which is configured with moisture-proof component parts, which is fixed to the cabinet, and in which the tubular hollow is formed. In this case, the drone cone includes: a first diaphragm, which is made from a moisture-impermeable material, and which has a first through-hole formed extending from the inside to the outside of the cabinet; an edge which is made from a moisture-impermeable material, which has a second through-hole having narrow openings, and which is fixed to the first diaphragm such that the first through-hole is connected to one extremity of the second through-hole and so as to cover one of the openings of the second through-hole; and a second diaphragm which is made from a moisture-impermeable material, which has a third through-hole, and which is fixed to the edge such that the third through-hole is connected to the other extremity of the second through-hole and so as to cover the other opening of the second through-hole. The tubular hollow may be formed by the first to third through-holes.

Still preferably, the speaker system may further includes a moisture absorbent material which is provided in the vicinity of the tubular hollow so as to absorb moisture.

Still preferably, the speaker system further includes a divider for dividing an internal cavity of the cabinet into a first cavity and a second cavity; a drone cone which is configured with moisture-proof component parts, and which is fixed to the divider; and a port for acoustically connecting the first cavity to the outside of the cabinet. The speaker unit may be fixed to the cabinet such that the speaker unit is in contact with the first cavity. The gas adsorbent may be situated inside the second cavity. The tubular structure may have the tubular hollow for allowing ventilation between the second cavity and the outside of the cabinet.

The present invention is also directed to a portable terminal apparatus and an audio-visual apparatus. Each of the portable terminal apparatus and the audio-visual apparatus includes the speaker system of the present invention and a housing accommodating the speaker system thereinside. Further, the present invention is directed to a vehicle. The vehicle includes the speaker system of the present invention and a vehicle body accommodating the speaker system thereinside.

These and other objects, features, aspects and advantages of the present invention will become more apparent from the following detailed description of the present invention when taken in conjunction with the accompanying drawings.

DETAILED DESCRIPTION OF THE INVENTION

Hereinafter, embodiments of the present invention will be described with reference to diagrams.

Embodiment 1

Figure 1:
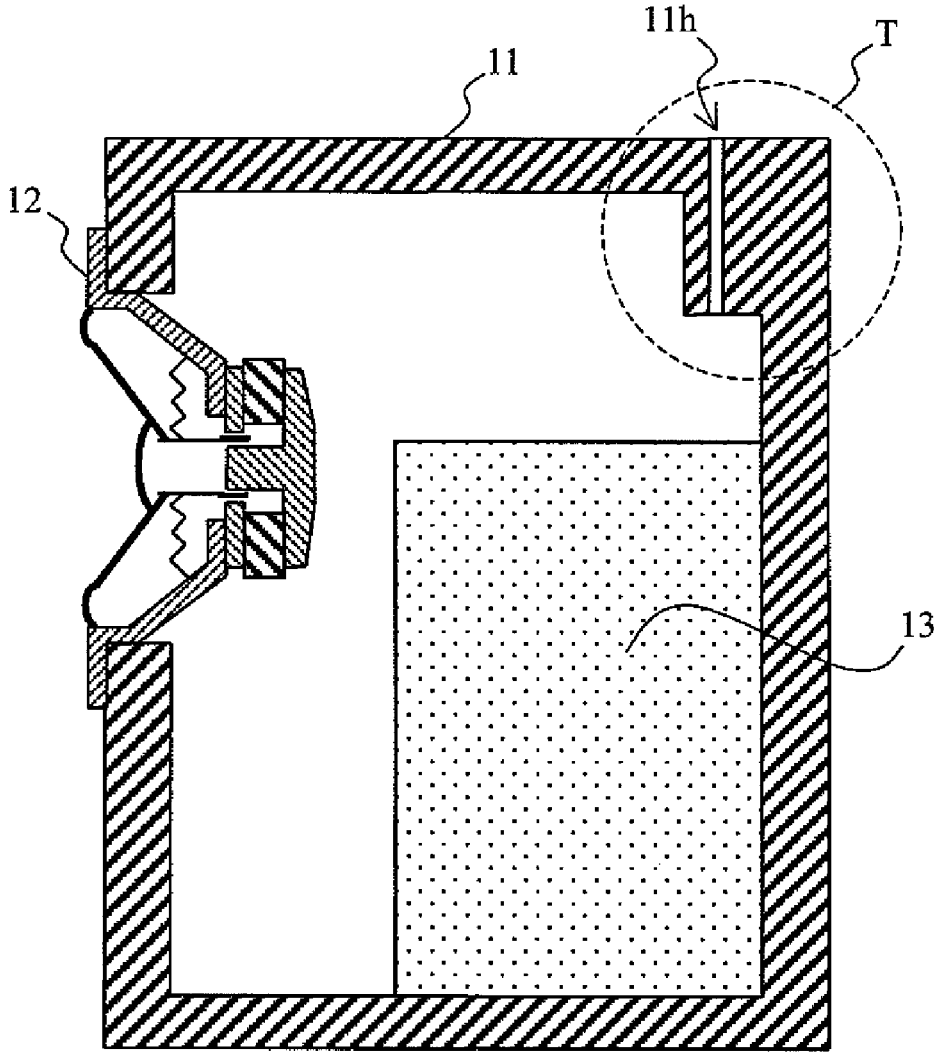
FIG. 1 is a tectonic profile of a speaker system according to embodiment 1 of the present invention.

FIG. 1 is a tectonic profile of a speaker system according to embodiment 1 of the present invention. As shown in FIG. 1, the speaker system is a closed-type speaker system, and includes a cabinet 11, a speaker unit 12 and a gas adsorbent 13.

The speaker unit 12 is fixed to the cabinet 11, and the speaker unit 12 includes a diaphragm and an edge which are each made from a moisture-impermeable material. The cabinet 11 is also made from the moisture-impermeable material. A tubular structure T has a tubular hollow Th which allows ventilation between an inside and an outside of the cabinet 11, and the tubular structure T is configured with the cabinet 11. Specifically, a through-hole 11*h* is formed on a top surface of the cabinet 11, and the through-hole 11*h* forms the tubular hollow Th. A length and an effective radius of the tubular hollow Th are set such that a resonant frequency, which is determined in accordance with an acoustic impedance of the tubular structure T and an acoustic impedance of the cabinet 11, is lower than the minimum resonant frequency of an acoustic impedance of the entire speaker system. A method for setting the length and the effective radius of the tubular hollow Th will be described later in detail.

The gas adsorbent 13 is made from a porous material having an air molecules adsorption/desorption action, and is situated inside the cabinet 11. As an example of the porous material, the activated carbon, carbon nanotube, fullerene, zeolite, silica ($SiO_2$), alumina ($Al_2O_3$), zirconia ($ZrO_2$), magnesia (MgO), triiron tetroxide ($Fe_3O_4$), and molecular sieve, and the like may be used.

Figure 2:
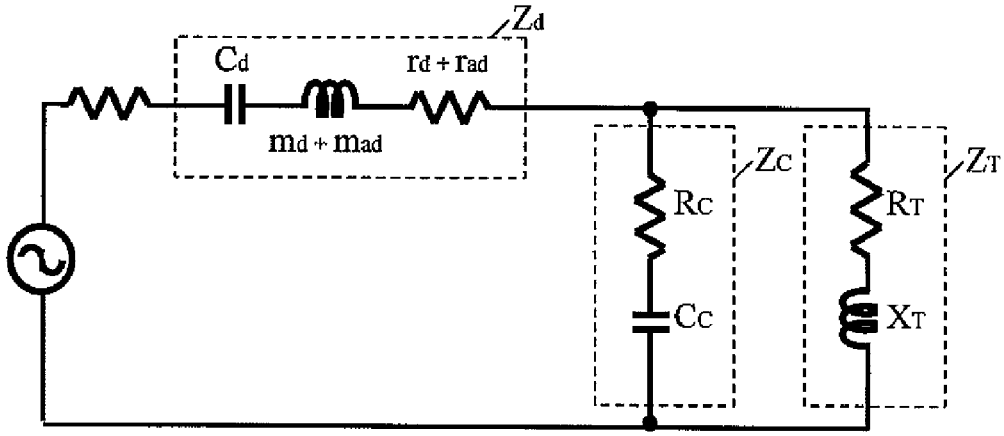
FIG. 2 is a diagram showing a machine equivalent circuit of the speaker system shown in FIG. 1.

Next, with reference to FIG. 2, a method for setting the length and the effective radius of the tubular hollow Th will be described. FIG. 2 is a diagram showing a machine equivalent circuit of the speaker system shown in FIG. 1.

An acoustic impedance $Z_T$ of the tubular structure, in the case where a viscous resistance of the air is considered, is represented by the following equation (1).

[Equation 1]

$$Z_T = R_T + jX_T = \frac{lS_d^2}{\pi R^2}\left(\frac{8\mu}{R^2} + \frac{4}{3}j\omega\rho\right) \quad (1)$$

Wherein: $R_T$ indicates a mechanical resistance of the tubular hollow Th including the viscous resistance of the air; $X_T$ indicates a mass of the tubular hollow Th; l indicates the length of the tubular hollow Th; R indicates the effective radius of the tubular hollow Th; μ indicates a coefficient of a viscosity of the air ($1.86\times10^{-5}$); ρ indicates a density of the air; and $S_d$ indicates an effective vibrating area of a diaphragm of the speaker unit 12.

An acoustic impedance $Z_C$ of the cabinet 11 which has the gas adsorbent 13 situated thereinside is represented by the following equation (2).

[Equation 2]

$$Z_C = R_C - j\frac{1}{\omega C_C} = S_d^2\left(R_C - j\frac{\rho c^2}{\omega V_C'}\right) \quad (2)$$

Wherein: $R_C$ indicates a mechanical resistance of the cabinet 11 including the gas adsorbent 13; $C_C$ indicates a mechanical compliance of the cabinet 11 including the gas adsorbent 13; c indicates an acoustic velocity; and $V_C'$ indicates an equivalent capacity of the cabinet 11 when the gas adsorbent 13 is situated thereinside.

An acoustic impedance $Z_d$ of the speaker unit 12 is represented by the following equation (3).

[Equation 3]

$$Z_d = S_d^2\left(j\omega(m_d + m_{ad}) + (r_d + r_{ad}) - j^2\frac{1}{\omega C_d}\right) \quad (3)$$

Wherein: $C_d$ indicates a mechanical compliance of a supporting system of the speaker unit 12; $m_d$ indicates a mass of the diaphragm of the speaker unit 12; $m_{ad}$ is an additional mass of the diaphragm of the speaker unit 12; and $r_d$ is a mechanical resistance of the speaker unit 12; $r_{ad}$ is a radiation resistance of the speaker unit 12.

Here, a minimum resonant frequency $f_{C\text{-}d}$ of the acoustic impedance of the entire speaker system corresponds to a resonant frequency which is determined by $Z_C$ and $Z_d$, and is represented by the following equation (4).

[Equation 4]

$$f_{C-d} = \frac{1}{2\pi}\sqrt{\frac{\frac{\rho c^2 S_d^2}{V_C'} + \frac{1}{C_d}}{m_d + m_{ad}}} \quad (4)$$

On the other hand, a resonant frequency $f_{C\text{-}T}$ which is determined by $Z_C$ and $Z_T$ is represented by the fowling equation (5).

[Equation 5]

$$f_{C-T} = \frac{1}{2\pi}\sqrt{\frac{\frac{\rho c^2 S_d^2}{V_C'}}{\frac{4}{3}\frac{\rho l S_d^2}{\pi R^2}}} = \frac{1}{2\pi}\sqrt{\frac{3\pi R^2 c^2}{4lV_C'}} \quad (5)$$

The length and the effective radius of the tubular hollow Th are set so as to satisfy the following equation (6).

[Equation 6]

$$f_{C\text{-}T} < f_{C\text{-}d} \quad (6)$$

Next, an operation of the speaker system as above configured will be described. When an acoustic signal is inputted to the speaker unit 12, the diaphragm of the speaker unit 12 vibrates, and the air pressure inside the cabinet 11 changes. However, the change in the air pressure inside the cabinet 11 is reduced by the adsorption/desorption action of the gas adsorbent 13, and thus the cabinet 11 operates as if equivalently having a large capacity. Accordingly, the speaker system having a small cabinet operates as if a speaker unit is fixed to a large cabinet, thereby reproducing a bass sound. The operation of the speaker system described so far is the same as that of the conventional speaker system.

When a temperature or an atmospheric pressure around the speaker system changes, the air confined inside the cabinet 11 inflates/deflates. When the inside of the cabinet 11 is completely sealed, the air pressure inside the cabinet 11 increases/decreases due to the inflation/deflation of the air. When the change in the air pressure is extremely large, the operation of the speaker unit 12 is disturbed thereby.

However, in the present embodiment, the tubular structure T, which has the tubular hollow Th whose length and effective radius satisfy equation (6), is configured with the cabinet 11. Accordingly, in the case of a significantly slow change in the temperature or in the atmospheric pressure around the speaker system, the air moves from the inside to the outside (or from the outside to the inside) of the cabinet 11 through the tubular hollow Th. Therefore, even if the air pressure inside the cabinet 11 increases/decreases due to the change in the temperature or in the atmospheric pressure around the speaker system, a difference in the pressure between the inside and the outside of the cabinet 11 is kept substantially null. Accordingly, the operation of the speaker unit 12 is not disturbed.

On the other hand, in the case of a significantly rapid change in the pressure in a frequency band in which the speaker unit 12 operates, the movement of the air from the inside to the outside (or from the outside to the inside) of the cabinet 11 through the tubular hollow Th is significantly reduced due to the viscosity of the air inside the tubular hollow Th. That is, while the speaker unit 12 is operating, the movement of the air through the tubular hollow Th is significantly reduced. This is because the length and the effective radius of the tubular hollow Th are set to satisfy equation (6).

As above described, in the present embodiment, the tubular structure T, which has the tubular hollow Th whose length and effective radius satisfy equation (6), is configured with the cabinet 11. Further, the speaker unit 12 is configured with moisture-proof component parts such as the diaphragm and the edge each of which is made from the moisture-impermeable material. Accordingly, it is possible to minimize the moisture flowing from the outside to the inside of the cabinet 11 which has the gas adsorbent 13 situated thereinside. The diaphragm made from the moisture-impermeable material is typified by a diaphragm which is wholly or partially made from resin, a metal diaphragm, and a resin diaphragm having a thin metal film deposited on a surface thereof. The moisture-impermeable material used for the edge is typified by solid rubber, closed-cell rubber, closed-cell urethane, resin, and resin having a thin metal film deposited on a surface thereof.

In the present embodiment, the cabinet 11 is made from the moisture-impermeable material. Therefore, it is possible to prevent the moisture from flowing from the outside to the inside of the cabinet 11. The cabinet made from the moisture-impermeable material is typified by a resin cabinet, a wooden cabinet having resin coated on a surface thereof, and a metal cabinet.

Figure 3:
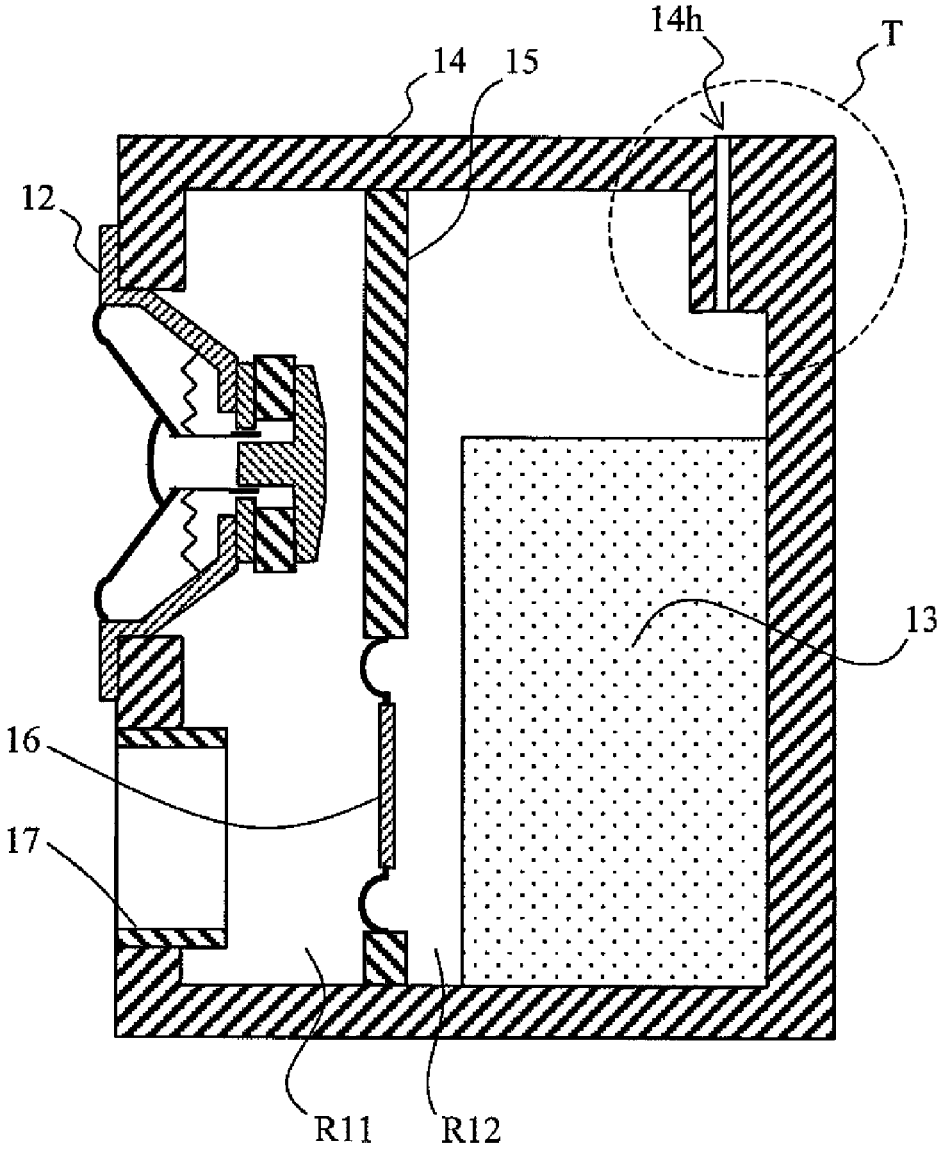
FIG. 3 is a tectonic profile of the speaker system in which phase inversion method using a port is used.

The above description is exemplified by a case where the closed-type speaker system is adopted. However, without limiting to the closed-type, a drone cone, an anti-standing-wave method, and the like may be adopted. In the case of adopting a phase inversion method using a port, a speaker system as shown in FIG. 3 may be used, for example. FIG. 3 is a tectonic profile of the speaker system which adopts the phase inversion method using the port. As shown in FIG. 3, the speaker system includes a cabinet 14, the speaker unit 12, the gas adsorbent 13, a divider 15, a drone cone 16, and a port 17. The speaker system shown in FIG. 3 is different from the speaker system shown in FIG. 1 in that the cabinet 14 is used in replacement of the cabinet 11, and the speaker system shown in FIG. 3 further includes the divider 15, the drone cone 16, and the port 17. The divider 15 is made from the moisture-impermeable material, and divides the internal cavity of the cabinet 14 into R11 and R12. The drone cone 16 is made from the moisture-impermeable material, and is fixed to the divider 15. The port 17 is fixed to the cabinet 14 such that the outside of the cabinet 14 and the internal cavity R11 are acoustically connected to each other. The cabinet 14 is different from the cabinet 11 in that an opening section to fix the port 17 thereto is provided. A through-hole 14*h* has the same length and the same effective radius as the through-hole 11*h*. The speaker unit 12 is situated so as to be in contact with the internal cavity R11. The gas adsorbent 13 is situated inside the internal cavity R12. The through-hole 14*h* may be formed in the divider 15.

When any of the methods other than the closed-type method is used, the length and the effective radius of the tubular hollow Th may be also set such that the resonant frequency, which is determined in accordance with the acoustic impedance of the tubular structure T and the acoustic impedance of the cabinet 11, is lower than the minimum resonant frequency of the acoustic impedance of the entire speaker system.

Figure 4:
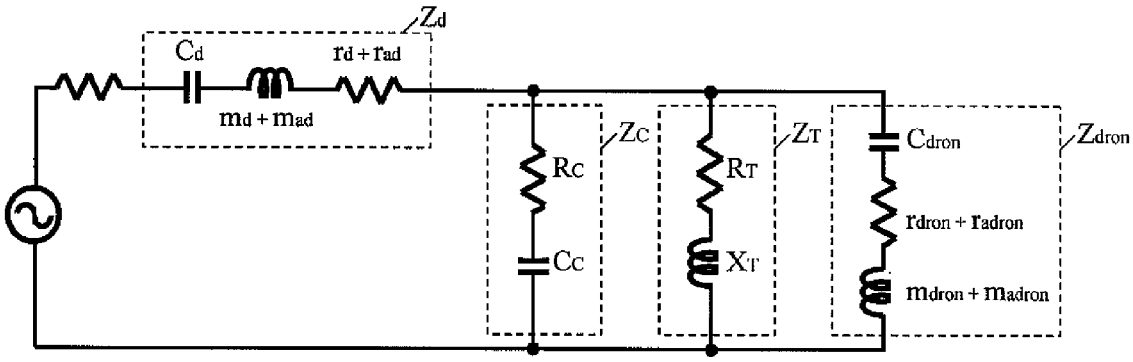
FIG. 4 is a diagram showing a machine equivalent circuit of the speaker system in which a drone cone is used.

Hereinafter, with reference to FIG. 4, a method for setting the length and the effective radius of the tubular hollow Th in the case the drone cone is used will be described. FIG. 4 is a diagram showing a machine equivalent circuit of the speaker system which includes the drone cone. The acoustic impedance $Z_T$ of the tubular structure T is represented by equation (1), and the acoustic impedance $Z_C$ of the cabinet 11 is represented by equation (2). The resonant frequency $f_{C\text{-}T}$, which is determined in accordance with $Z_C$ and $Z_T$, is represented by equation (5).

An acoustic impedance $Z_{dron}$ of the drone cone is represented by equation (7).

[Equation 7]

$$Z_{dron} = \left(\frac{S_d}{S_{dron}}\right)^2 \left\{ j\omega(m_{dron} + m_{adron}) + (r_{dron} + r_{adron}) - j^2 \frac{1}{\omega C_{dron}} \right. \tag{7}$$

Wherein: $S_{dron}$ indicates an effective vibrating area of the drone cone; $m_{dron}$ indicates a mass of the drone cone; $m_{adron}$ indicates an additional mass of the drone cone; $r_{dron}$ indicates a mechanical resistance of the drone cone; $r_{adron}$ indicates a radiation resistance of the drone cone; and $C_{dron}$ indicates a mechanical compliance of a supporting system of the drone cone.

Here, the minimum resonant frequency $f_{C\text{-}d}$ of the acoustic impedance of the entire speaker system corresponds to the resonant frequency, which is determined by $Z_C$ and $Z_{dron}$, and is represented by equation (8).

[Equation 8]

$$f_{C-dron} = \frac{1}{2\pi}\sqrt{\frac{\frac{\rho c^2 S_d^2}{V_C'} + \frac{1}{C_{dron}}}{m_{dron} + m_{adron}}} \tag{8}$$

The length and the effective radius of the tubular hollow Th are set to satisfy equation (9).

[Equation 9]

$$f_{C\text{-}T} < f_{C\text{-}dron} \tag{9}$$

For, example, when an effective radius of the speaker unit 12, whose diameter ϕ is 80 [mm], is 35 [mm], the effective vibrating area $S_d$ becomes equal to $3.84\times10^{-3}$ [$cm^2$]. An equivalent capacity Vc' of the cabinet 11 becomes equal to $1.3\times10^{-3}$ [$m^3$]. When the effective radius R of the tubular hollow Th is $0.3\times10^{-3}$ [m] and a length l is $3\times10^{-3}$ [m], the resonant frequency $f_{C\text{-}T}$ becomes equal to 12.8 [Hz] according to equation (5). When the effective radius R of the tubular hollow is $0.2\times10^{-3}$ [m] and the length l is $8\times10^{-3}$ [m], the resonant frequency $f_{C\text{-}T}$ becomes equal to 10.4 [Hz] according to equation (5). On the other hand, when the mass $m_{dron}$ of the drone cone is $10\times10^{-3}$ [kg], an added mass $m_{adron}$ of the drone cone is $0.4\times10^{-3}$ [kg], and the compliance $C_{dron}$ of the drone cone is $0.8\times10^{-3}$ [m/N], then the resonant frequency $f_{c\text{-}dron}$ becomes equal to 83 [Hz] according to equation (8). In any case, the resonant frequency $f_{C\text{-}T}$ is sufficiently lower than the resonant frequency $f_{c\text{-}dron}$.

In the above description, although a method for fixing the speaker unit 12 to the cabinet 11 is not described specifically, an adhesive agent or a sealing agent may be applied to a position to which the speaker unit 12 is fixed. Alternatively, rubber, silicone, urethane foam or the like may be used. Accordingly, it is possible to prevent the moisture entering from the position to which the cabinet 11 is fixed. Further, in order to securely prevent the moisture from flowing in, the adhesive agent or the sealing agent may be applied to a threaded hole, which is formed on the cabinet 11 so as to fix the speaker unit 12, or may be applied to a screw for fixing the speaker unit 12.

Further, in the vicinity of the through-hole 11*h* inside the cabinet 11, a moisture absorbent material which absorbs the moisture having flown inside the cabinet 11 may be situated. The moisture absorbent material may be, for example, made from silica gel, calcium chloride, quicklime, aluminum oxide, calcium oxide, activated anhydrous calcium sulfate, magnesium oxide, magnesium perchlorate, magnesium sulfate, sodium hydrate, sodium sulfate, zinc chloride and the like.

Further, according to the above description, although only one speaker unit 12 is fixed to the cabinet 11, two or more speaker units 12 may be fixed to the cabinet 11.

Embodiment 2

Figure 5:
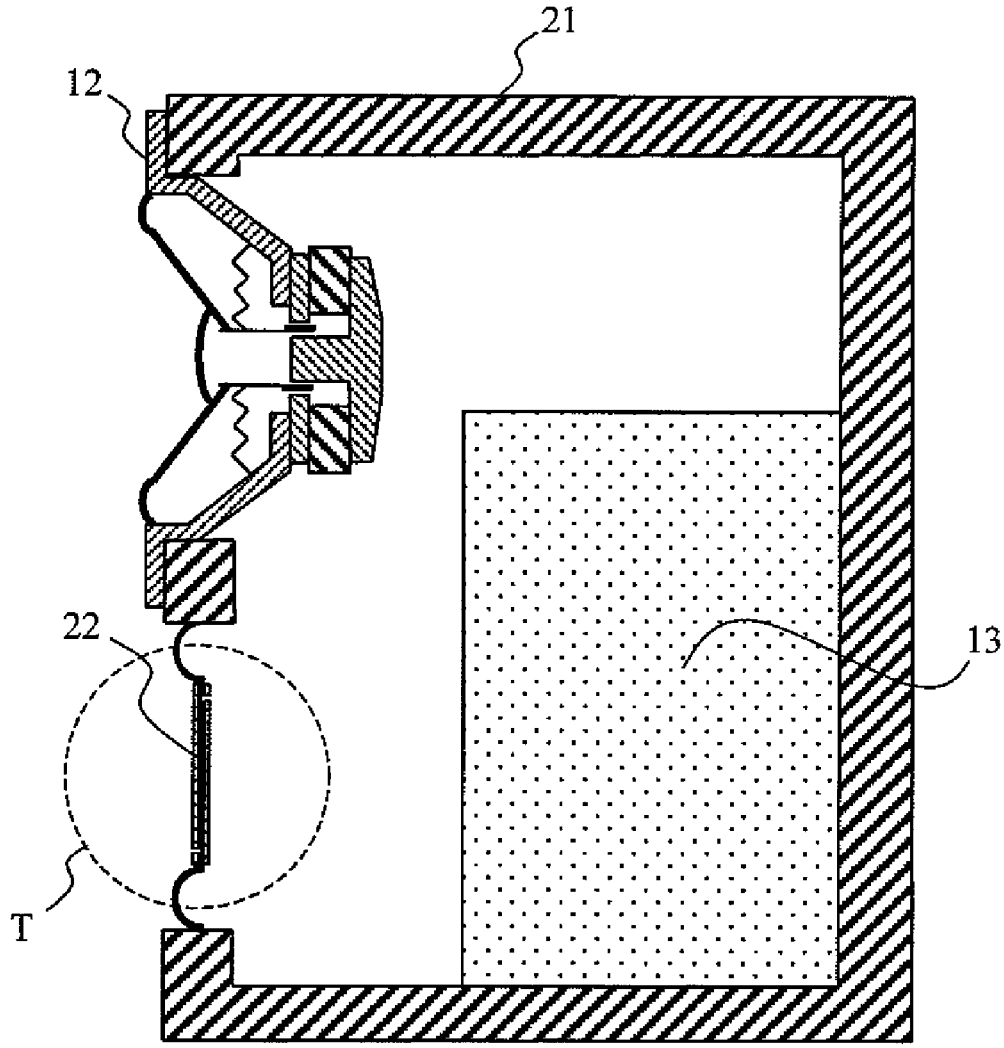
FIG. 5 is a tectonic profile of a speaker system according to embodiment 2 of the present invention.

FIG. 5 is a tectonic profile of a speaker system according to embodiment 2 of the present invention. As shown in FIG. 5, the speaker system is a drone cone type speaker system, and includes a cabinet 21, the speaker unit 12, the gas adsorbent 13, and a drone cone 22. The speaker system according to the present embodiment is different form the speaker system shown in FIG. 1 in that the cabinet 21 is used in replacement of the cabinet 11, and further the drone cone 22 is included. Still further, the tubular structure T is configured with the drone cone 22. Hereinafter, the different points will be mainly described.

In addition to the speaker unit 12, the drone cone 22 is fixed to the cabinet 21, and the cabinet 21 is made from the moisture-impermeable material.

Figure 6:
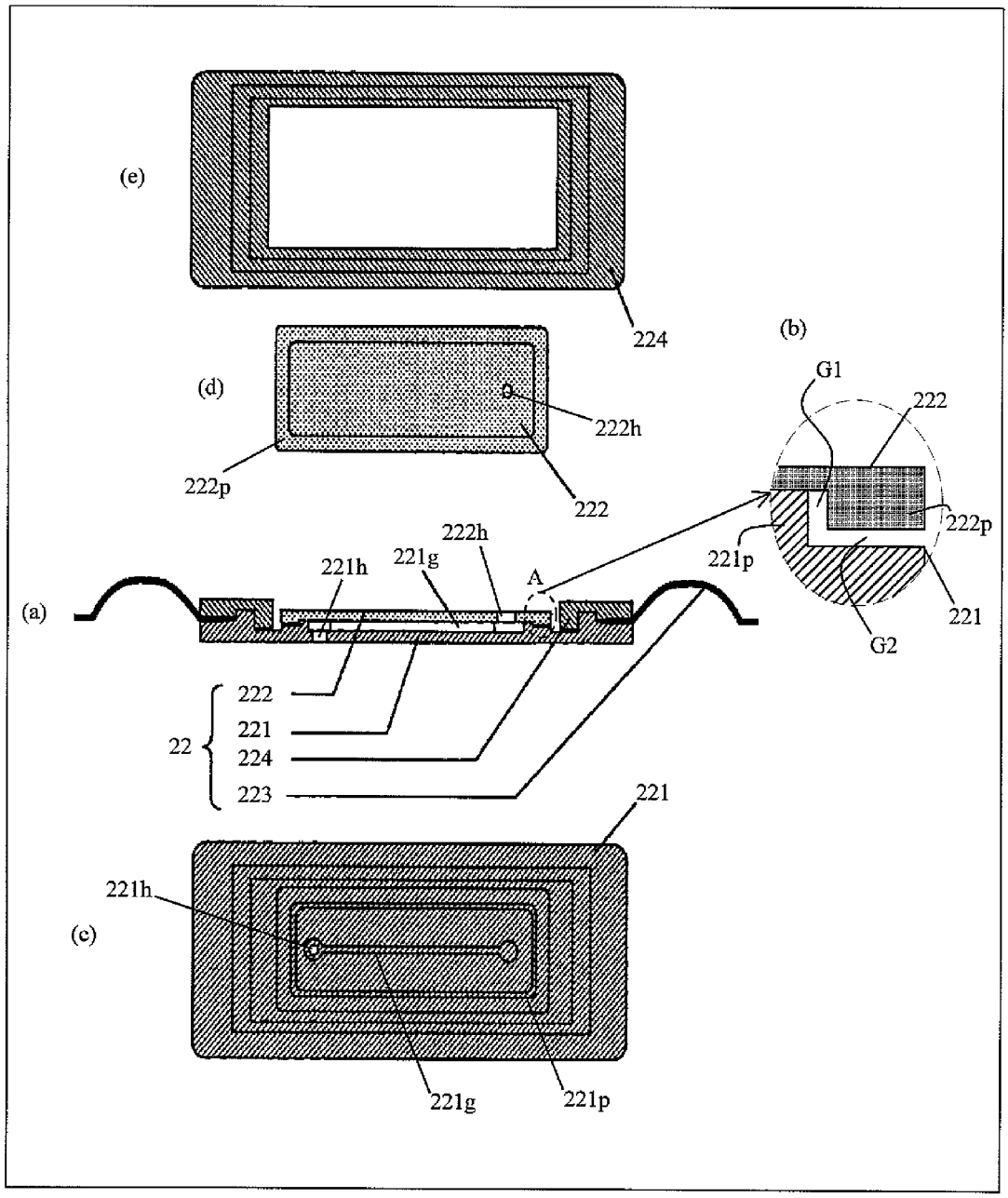
FIG. 6 is a diagram showing, in detail, a structure of a drone cone 22.

The drone cone 22 includes, as shown in FIG. 6, a first diaphragm 221, a second diaphragm 222, an edge 223, and a fixing material 224. These sections are each made from the moisture-impermeable material. FIG. 6 is a diagram showing, in detail, a structure of the drone cone 22. FIG. 6(*a*) is a tectonic profile of the drone cone 22. FIG. 6(*b*) is an enlarged view of a portion of the drone cone 22, the portion being surrounded by dotted lines A. FIG. 6(*c*) is a diagram of the first diaphragm 221 shown in FIG. 6(*a*) as viewed from an upper side thereof. FIG. 6(*d*) is a diagram of the second diaphragm 222 shown in FIG. 6(*a*) as viewed from a lower side thereof. FIG. 6(*e*) is a diagram of the fixing material 224 shown in FIG. 6(*a*) as viewed from a lower side thereof.

As shown in FIG. 6(*c*), a protruding section 221*p* is formed on the first diaphragm 221, and a channel 221*g* is formed in a range surrounded by the protruding section 221*p*. At one extremity of the channel 221*g*, a through-hole 221*h* is formed. As shown in FIG. 6(*d*), the protruding section 222*p* is formed at an outer circumference portion of the second diaphragm 222, and a through-hole 222*h* is formed in a range surrounded by a protruding section 222*p*. As shown in FIG. 6(*a*), the second diaphragm 222 is fixed on the first diaphragm 221 such that the through-hole 222*h* is connected to the other extremity of the channel 221*g* and such that the channel 221*g* is covered with the second diaphragm 222. Accordingly, the tubular hollow Th is formed by the through-hole 221*h*, the channel 221*g* and the through-hole 222*h*. The length and the effective radius of the tubular hollow Th are set to satisfy equation (9). An inner circumference portion of the edge 223 is fixed on an outer circumference portion of the first diaphragm 221. The fixing material 224 is fixed on the inner circumference portion of the edge 223, and the inner circumference portion of the edge 223 is fixed between the fixing material 224 and the outer circumference portion of the first diaphragm 221.

As shown in FIG. 6(*b*), the protruding section 222*p* of the second diaphragm 222 is located at an outer side of the protruding section 221*p* of the first diaphragm 221, and an air gap G2 is formed between the protruding section 222*p* and the protruding section 221*p*. A vertical height of the protruding section 222*p* is lower than that of the protruding section 221*p*, and an air gap G2 is formed between a lower surface of the protruding section 222*p* and a top surface of the first diaphragm 221. Accordingly, when the second diaphragm 222 is fixed on the first diaphragm 221, a top surface of the protruding section 221P is inevitably in contact with a lower surface of the second diaphragm 222, and thus it is possible to form the tubular hollow Th unfailingly. An adhesive agent for bonding the first diaphragm 221 and the second diaphragm 222 is applied to an outer circumference portion of the top surface of the protruding section 221*p*. Accordingly, the adhesive agent tends to flow from the air gap G1 to the air gap G2, and thus it is possible to prevent the tubular hollow Th from being filled with the adhesive agent.

As above described, in the present embodiment, the tubular structure T, which has the tubular hollow Th whose length and the effective radius satisfy equation (9), is configured with the drone cone 22. Further, the speaker unit 12 and the drone cone 22 are each configured with the moisture-proof component parts. Accordingly, in the same manner as embodiment 1, it is possible to minimize the moisture flowing from the outside to the inside of the cabinet 21 which has the gas adsorbent 13 situated thereinside.

The inventor of the present invention has confirmed an effect of the present embodiment by performing a simulation of the sound-pressure frequency characteristic and by measuring time variation of an amount of moisture adsorption by the gas adsorbent 13. Hereinafter, the result of the simulation and the measurement will be described in detail.

Figure 7:
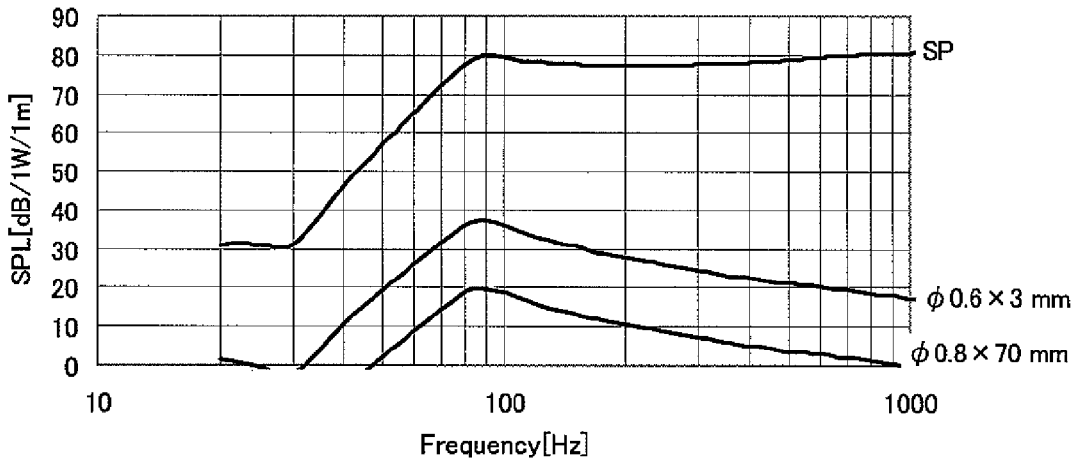
FIG. 7 is a diagram showing a simulation result of a sound-pressure frequency characteristic performed by using the machine equivalent circuit shown in FIG. 4.

FIG. 7 is a diagram showing the simulation result of the sound-pressure frequency characteristic in the case where the machine equivalent circuit shown in FIG. 4 is used. In FIG. 7, shown are a sound-pressure frequency characteristic of a speaker unit (SP) 12, a sound-pressure frequency characteristic which is caused by the air flowing in and out through the tubular hollow Th having a diameter $\phi$ of 0.6 [mm] and a length l of 3 [mm] (i.e., effective radius R: $0.3\times10^{-3}$ [m], length l: $3\times10^{-3}$ [m]), and a sound-pressure frequency characteristic which is caused by the air flowing in and out through the tubular hollow Th having a diameter $\phi$ of 0.8 [m] and a length l of 70 [mm] (i.e., effective radius R: $0.4\times10^{-3}$ [m], length l: $70\times10^{-3}$ [m]) In the machine equivalent circuit shown in FIG. 4, an effective radius of the speaker unit 12, whose diameter $\phi$ is 80 [mm], is 35 [mm], and an equivalent capacity Vc' of the cabinet 21 become equal to $1.3\times10^{-3}$ [$m^3$]. Further, both of the parameters of the tubular hollows Th (i.e., the effective radius R: $0.3\times10^{-3}$ [m], the length l: $3\times10^{-3}$ [m], and the effective radius R: $0.4\times10^{-3}$[m], the length l: $70\times10^{-3}$ [m]) satisfy equation (9).

According to a result shown in FIG. 7, it is clear that a volume of a sound (SPL) outputted from the tubular hollow Th is reduced when the length and the effective radius of the tubular hollow Th are set to satisfy equation (9). That is, an amount of the air passing through the tubular hollow Th is reduced. The longer the length of the tubular hollow Th is, the more the volume of the sound outputted from the tubular hollow Th is reduced. Further, due to the reduction in the volume of the sound outputted from the tubular hollow Th, an interference, caused by an opposite-phase sound, of a reproduced sound outputted from the speaker apparatus is reduced, and the reproduced sound pressure in a low frequency band is improved. Still further, a sound distortion, which is caused by an air friction sound occurring in the vicinity of openings of the tubular hollow Th, is reduced.

Figure 8:
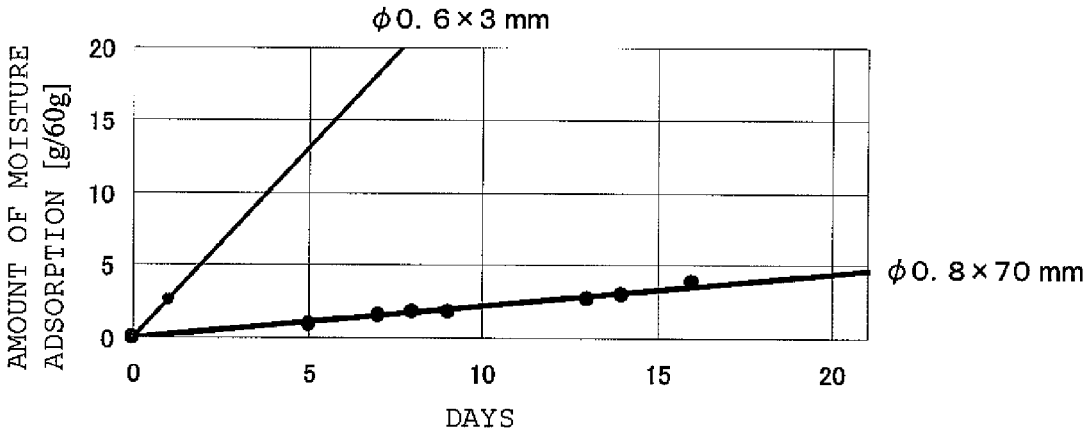
FIG. 8 is a diagram showing a measurement result of time variation of an amount of moisture adsorption by a gas adsorbent 13.

FIG. 8 is a diagram showing the measurement result of the time variation of the amount of the moisture adsorption by the gas adsorbent 13. In FIG. 8, the time variation of the amount of the moisture adsorption by the gas adsorbent 13 is measured under a condition where the speaker system is driven by a DIN noise of 13 [W] and where the speaker system is situated inside a thermoregulated bath having a temperature of 55 degrees and a humidity of 95%.

According to a result shown in FIG. 8, it is clear that an absorbing speed of the gas adsorbent 13 slows down when the length and the effective radius of the tubular hollow Th are set to satisfy equation (9). Further, the longer the length of the tubular hollow Th is, the more the absorbing speed slows down.

In this manner, according to the results shown in FIGS. 7 and 8, when the length and the effective radius of the tubular hollow Th are set to satisfy equation (9), it is possible to prevent, in the frequency band in which the speaker unit 12 operates, the moisture flowing from the outside to the inside of the cabinet 21 which has the gas adsorbent 13 situated thereinside, and also possible to minimize the flowing-in of the moisture in a whole frequency band. Further, the longer the length of the tubular hollow Th is, the more improved manner, it is possible to prevent the moisture flowing from the outside to the inside of the cabinet 21.

In the present embodiment, the drone cone is used. Accordingly, due to a resonance among an effective vibrating weight of the drone cone 22, a stiffness of the edge 223, and air stiffness of the inside of the cabinet 21, a frequency band of a reproduced sound is extended to a lower frequency band compared to the closed-type.

Further, in the case where the drone cone is used, the inside of the cabinet 21 is separated from the outside of the cabinet 21 by the cabinet 21, the speaker unit 12, and the drone cone 22. Accordingly, compared to the phase inversion method in which the port is fixed to the cabinet 11, the gas adsorbent 13 situated inside the cabinet 21 is hardly affected by the humidity outside the cabinet 21.

In Japanese National Phase PCT Laid-Open Publication No. 60-500645, the speaker system has a configuration in which the diaphragm 5, which is equivalent to the drone cone, divides the inside of the cabinet 1. Accordingly, a problem is posed in that the sound pressure is reduced in the low frequency band due to an increase in the weight of the diaphragm 5, which is caused by an addition of the bent tube 6. On the other hand, the speaker system according to the present embodiment has a configuration in which the drone cone 22 is fixed to the cabinet 21. That is, the speaker system has a configuration in which, due to the resonance among the effective vibrating weight of the drone cone 22, the stiffness of the edge 223, and the air stiffness of the inside of the cabinet 21, the frequency band of the reproduced sound is extended to the lower frequency band. In this case, the frequency band of the reproduced sound is extended to the lower frequency band due to an increase in the weight of the drone cone 22, and thus problems such as the reduction in the sound pressure in the low frequency band will not occur. Further, the weight of the drone cone 22 is increased due to the tubular structure T, and the increase in the weight leads to the extension of the frequency band of the reproduced sound to the lower frequency band.

In the above description, in order to firmly fix the inner circumference portion of the edge 223, the second diaphragm 222 and the fixing material 224 are configured individually. However, without limiting to this, the second diaphragm 222 and the fixing material 224 may be configured in a unified manner.

Embodiment 3

Figure 9:
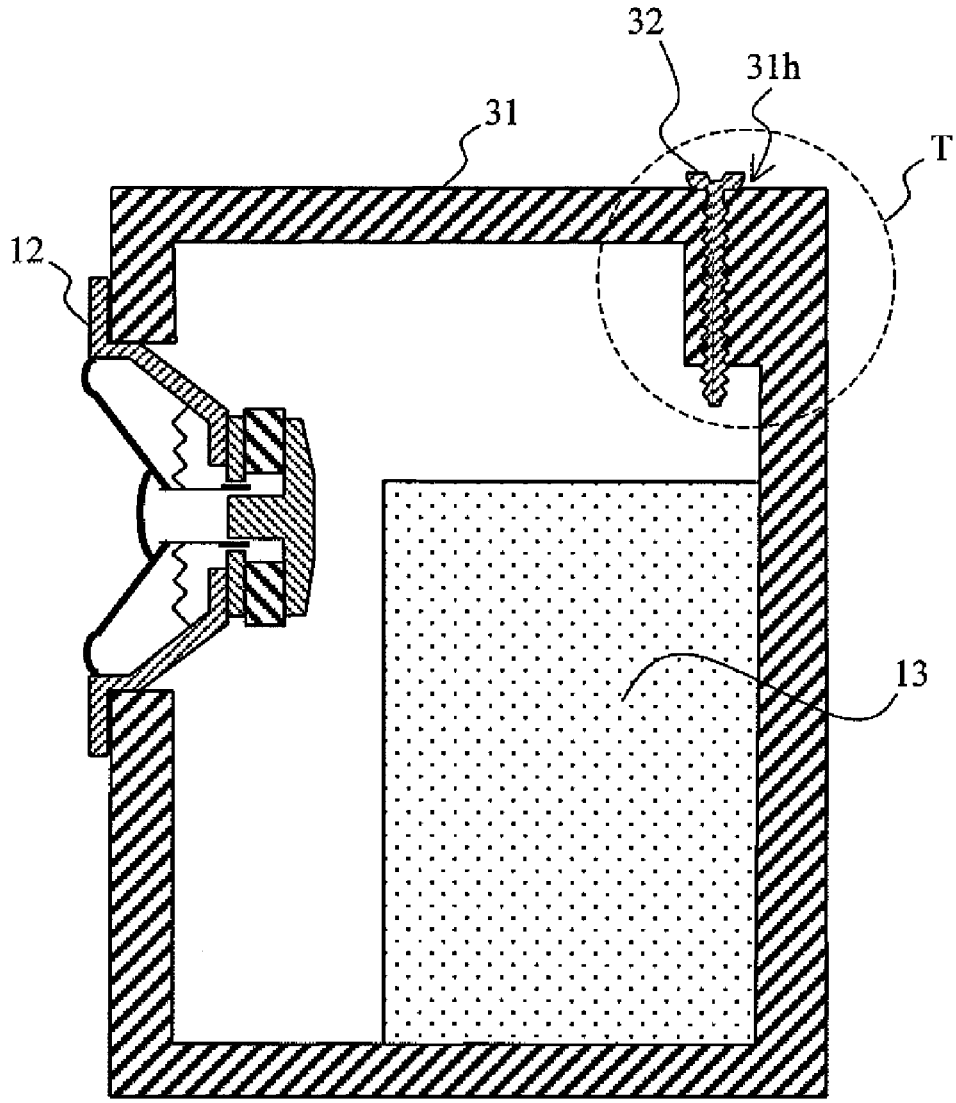
FIG. 9 is a tectonic profile of a speaker system according to embodiment 3 of the present invention.

FIG. 9 is a tectonic profile of a speaker system according to embodiment 3 of the present invention. In FIG. 9, the speaker system is the closed-type speaker system, and includes a cabinet 31, the speaker unit 12, the gas adsorbent 13 and a screw 32. The speaker system according to the present embodiment is different from the speaker system shown in FIG. 1 in that the cabinet 31 is used in replacement of the cabinet 11, and the screw 32 is further included. Further, the tubular structure T is configured with the cabinet 31 and the screw 32. Hereinafter, the different points will be mainly described.

Figure 10:
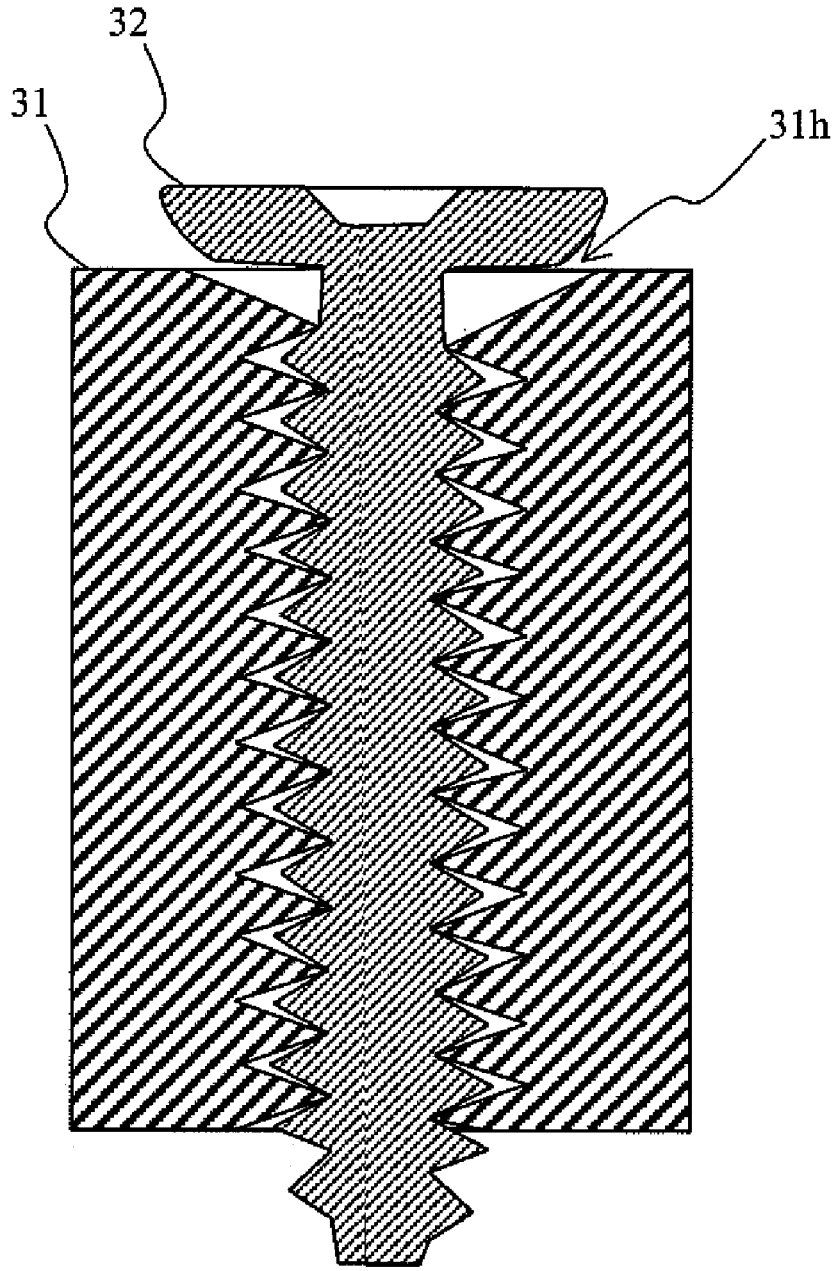
FIG. 10 is an enlarged view of a tubular structure T shown in FIG. 9.

The speaker unit 12 is fixed to the cabinet 31, and the cabinet 31 is made from the moisture-impermeable material. As shown in FIG. 10, a through-hole 31*h* is formed in the cabinet 31, and an inner surface of the through-hole 31*h* is shaped so as to accommodate screw threads and thread grooves of the screw 32. FIG. 10 is an enlarged view of the tubular structure T shown in FIG. 9. A depth of the grooves formed on the inner surface of the through-hole 31*h* is deeper than a height of the screw threads of the screw 32. Therefore, when the screw 32 is inserted into the cabinet 31, a gap is formed between the screw threads and the grooved inner surface of the through-hole 31*h*. Due to the gap, the tubular hollow Th of a spiral shape is formed. The length and the effective radius of the tubular hollow Th are set to satisfy equation (6).

As above described, in the present embodiment, the tubular structure T, which has the tubular hollow Th whose length and the effective radius satisfy equation (6), is configured with the cabinet 31 and the screw 32. Further, the speaker unit 12 is configured with the moisture-proof component parts. Accordingly, in the same manner as the embodiment 1, it is possible to minimize the moisture flowing from the outside to the inside of the cabinet 31 which has the gas adsorbent 13 situated thereinside.

Figure 11:
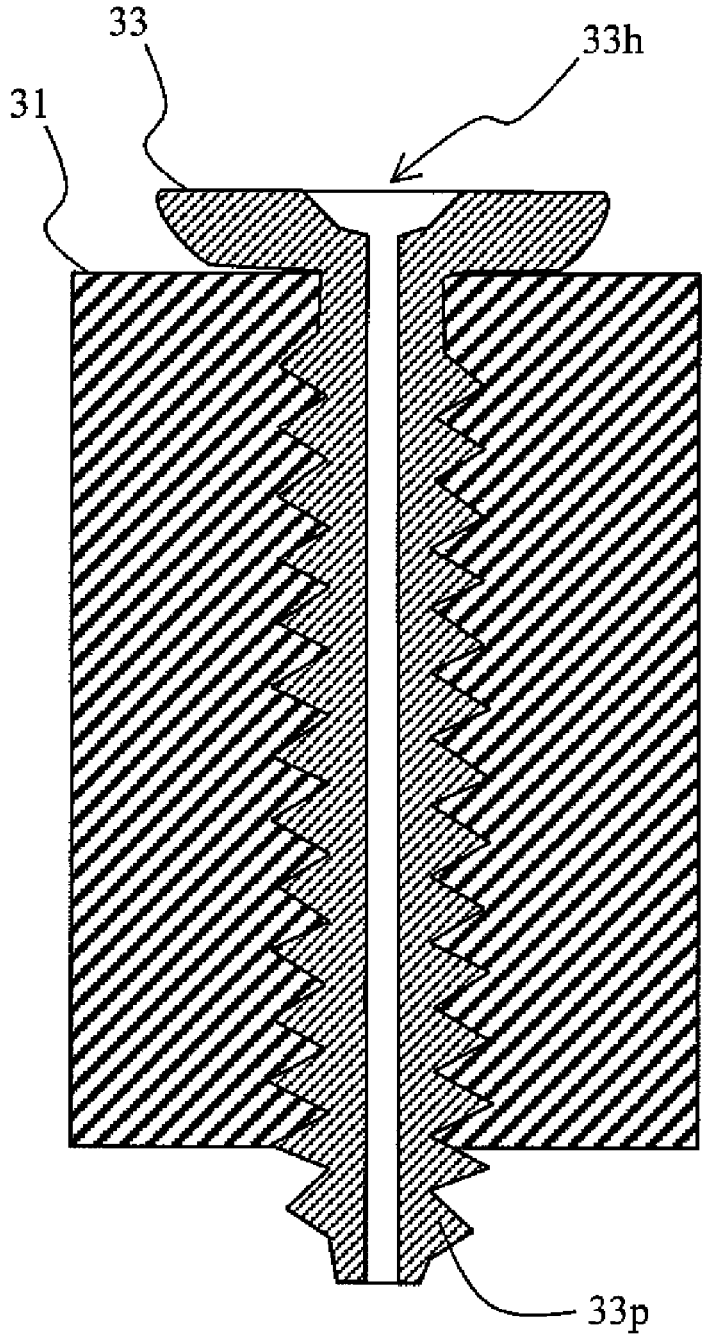
FIG. 11 is an enlarged view of the tubular structure T in the case where a screw 33 is provided to the speaker system.

In the above description, the speaker system includes the screw 32, however, the screw 32 may be replaced with a screw 33 shown in FIG. 11. FIG. 11 is an enlarged view of the tubular structure T in the case where the speaker system includes the screw 33. As shown in FIG. 11, an end 33*p* of the screw 33 protrudes from an inner wall surface to an internal cavity of the cabinet 31. The screw 33 has a through-hole 33*h* formed thereinside penetrating from a top to the end 33*p* of the screw 33. With the through-hole 33*h*, the tubular hollow Th is formed, which allows ventilation between the inside and the outside of the cabinet 31. When the screw 33 like this is used, it is not necessary to form the through-hole 31*h*, whose inner surface has a complicated shape, in the cabinet 31. Therefore, it is possible to form the tubular hollow Th easily and stably.

Embodiment 4

Figure 12:
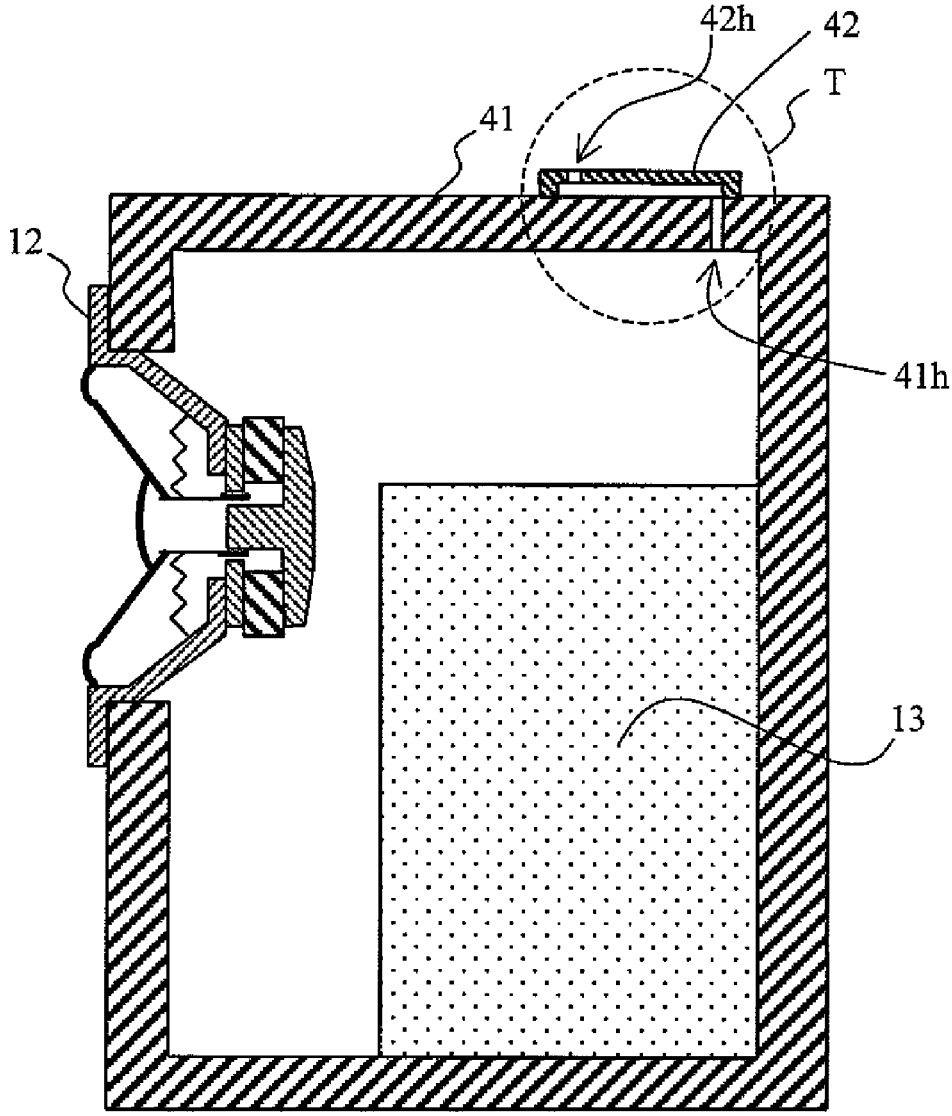
FIG. 12 is a tectonic profile of a speaker system according to embodiment 4 of the present invention.

FIG. 12 is a tectonic profile of a speaker system according to embodiment 4 of the present invention. As shown in FIG. 12, the speaker system is the closed-type speaker system, and includes a cabinet 41, the speaker unit 12, the gas adsorbent 13, and a planar material 42. The speaker system according to the present embodiment is different from the speaker system shown in FIG. 1. in that the cabinet 41 is used in replacement of the cabinet 11 and the planar material 42 is further included. Further, the tubular structure T is configured with the cabinet 41 and the planar material 42. Hereinafter, the different points will be mainly described.

The speaker unit 12 is fixed to the cabinet 41, and the cabinet 41 is made from the moisture-impermeable material. A through-hole 41*h* is formed in the cabinet 41.

Figure 13:
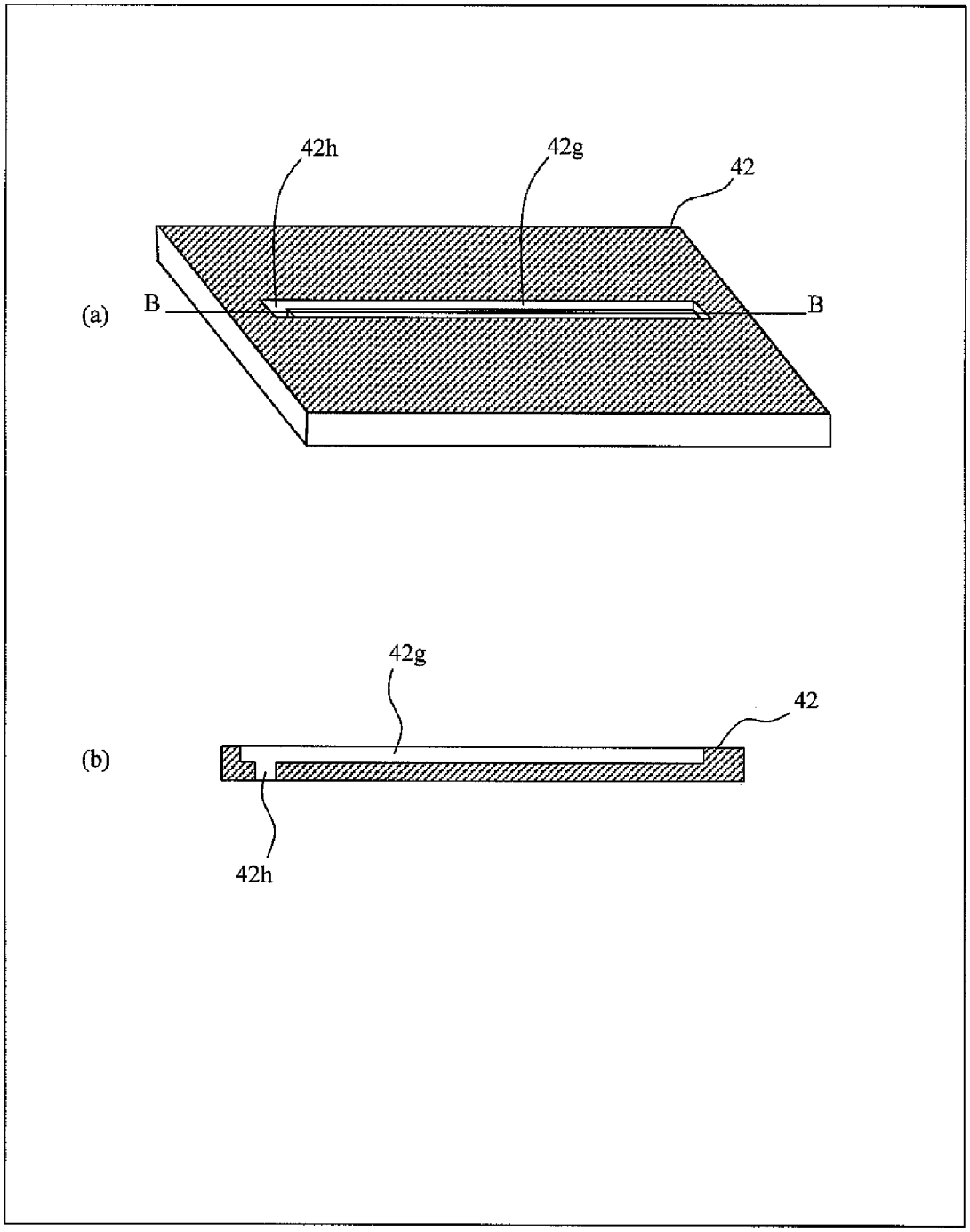
FIG. 13 is a diagram showing, in detail, a structure of a planar material 42.

As shown in FIG. 13, in the planar material 42, formed are a channel 42*g* which is of a linear shape, and a through-hole 42*h* which is situated at one extremity of the channel 42*g*.

Figure 14:
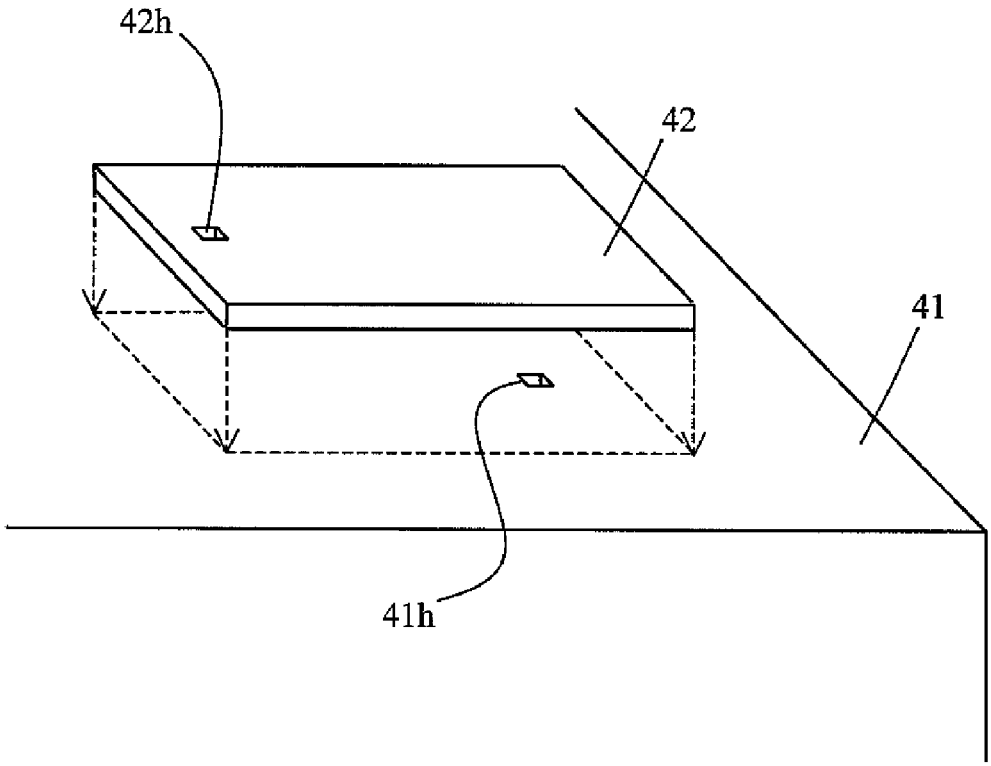
FIG. 14 is a diagram showing a manner of fixing the planar material 42 to a cabinet 41.

FIG. 13 is a diagram showing, in detail, a structure of the planar material 42. FIG. 13(*a*) is a perspective view of the planar material 42. FIG. 13(*b*) is a tectonic profile of the planar material 42 as cut along a line BB shown FIG. 13(*a*). FIG. 13(*a*) shows a surface of the planar material 42 to be fixed to the cabinet 41. As shown in FIG. 14, the planar material 42 is fixed on a top surface of the cabinet 41, as indicated by dotted arrows, such that the other extremity of the channel 42*g* is connected to the through-hole 41*h* and such that the channel 41*g* is covered with the top surface of the cabinet 41. FIG. 14 is a diagram showing a manner of fixing the planar material 42 to the cabinet 41. Accordingly, the through-hole 41*h*, the channel 42*g*, and the through-hole 42*h* are connected to one another, whereby the tubular hollow Th is formed. The tubular hollow Th is set to satisfy equation (6).

As above described, in the present embodiment, the tubular structure T, which has the tubular hollow Th whose length and effective radius satisfy equation (6), is configured with the cabinet 41 and the planar material 42. Further, the speaker unit 12 is configured with the moisture-proof component parts. Therefore, in the same manner as embodiment 1, it is possible to minimize the moisture flowing from the outside to the inside of the cabinet 41 which has the gas adsorbent 13 situated thereinside.

Recently, the cabinet 41 of the speaker system is often made from resin, however, it is difficult to made the tubular hollow Th, which is extremely narrow and long, from the resin. In the present embodiment, the planar material 42, in which the through-hole 42*h* and the channel 42*g* are formed, is provided. Therefore, the through-hole, which is extremely narrow and long, is not necessarily made from the resin. Accordingly, it is possible to form the tubular hollow Th easily.

In the above description, the planar material 42 has a configuration in which only the channel 42*g* and the through-hole 42*h* are formed, but is not limited thereto. In order to prevent the adhesive agent to bond the planar material 42 and the cabinet 41 from entering into the tubular hollow Th, the planar material 42 may have another channel formed on the surface facing the top surface of cabinet 41 at a position different from that of the channel 42*g*. Alternatively, the channel may be formed on the surface of the cabinet 41, the surface facing the planar material 42, such that the channel does not directly face the channel 42*g*. Accordingly, it is possible to prevent the tubular hollow Th from being filled with the adhesive agent.

Figure 15:
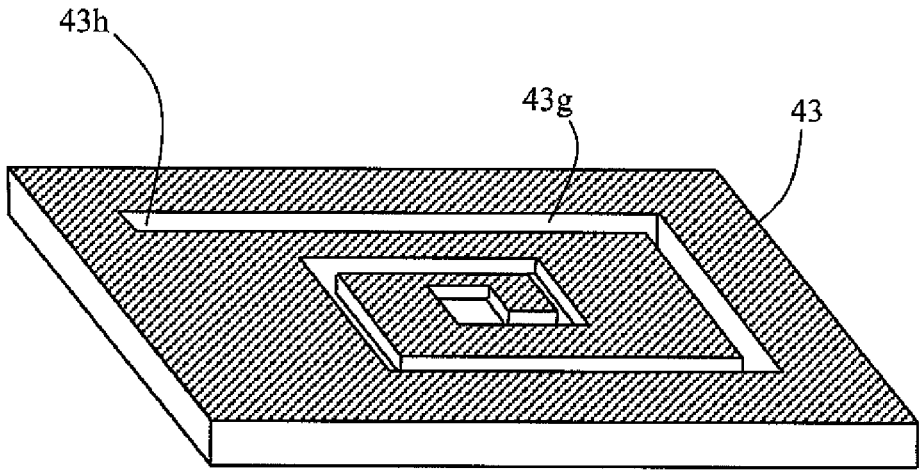
FIG. 15 is a perspective view of a planar material 43.
Figure 16:
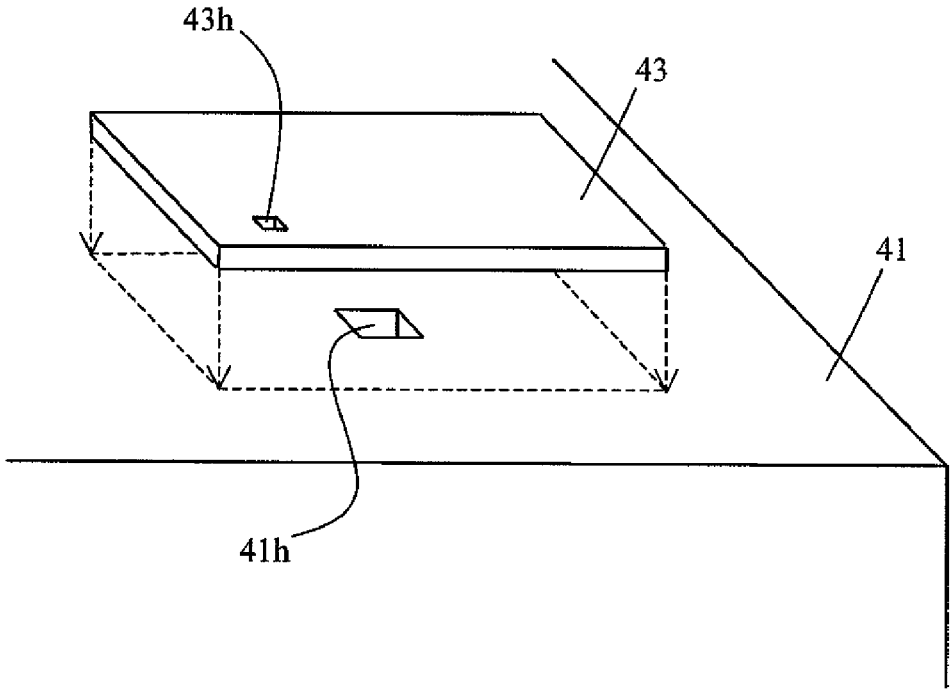
FIG. 16 is a diagram showing a manner of fixing the planar material 43 to the cabinet 41.

In the above description, the channel 42*g* formed in the planar material 42 is of the linear shape, but is not limited thereto. As shown in FIGS. 15 and 16, a planar material 43 may have a channel which is of a spiral shape as viewed from a surface to be fixed to the cabinet 41. FIG. 15 is a perspective view of the planar material 43. FIG. 16 is a diagram showing a manner of fixing the planar material 43 to the cabinet 41. FIG. 15 shows the surface of the planar material 43, which is fixed to the cabinet 41. As shown in FIGS. 15 and 16, in the planar material 43, formed are the channel 43*g* of the spiral shape and a through-hole 43*h* which is situated a tone extremity of the channel 43*g*. As shown in FIG. 16, the planar material 43 is fixed on the top surface of the cabinet 41 such that the other extremity of the channel 43*g* is connected to the through-hole 41*h* and such that the channel 43*g* is covered with the top surface of the cabinet 41. The planar material 43 having such configuration is used, whereby it is possible to easily form the long tubular hollow Th in a narrow area.

Figure 17:
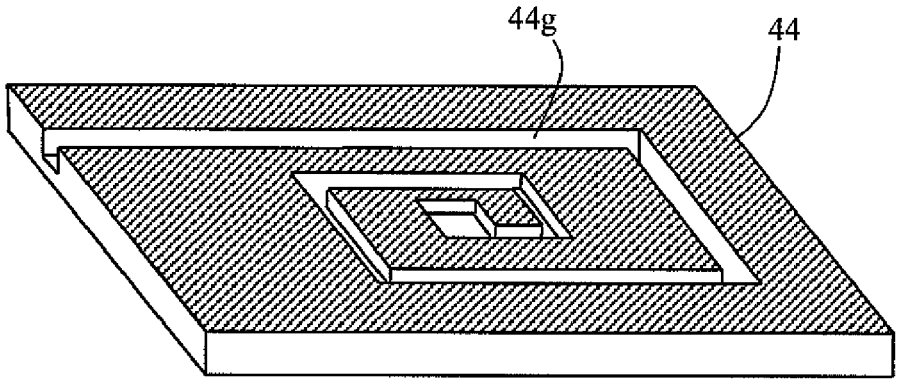
FIG. 17 is a perspective view of a planar material 44.
Figure 18:
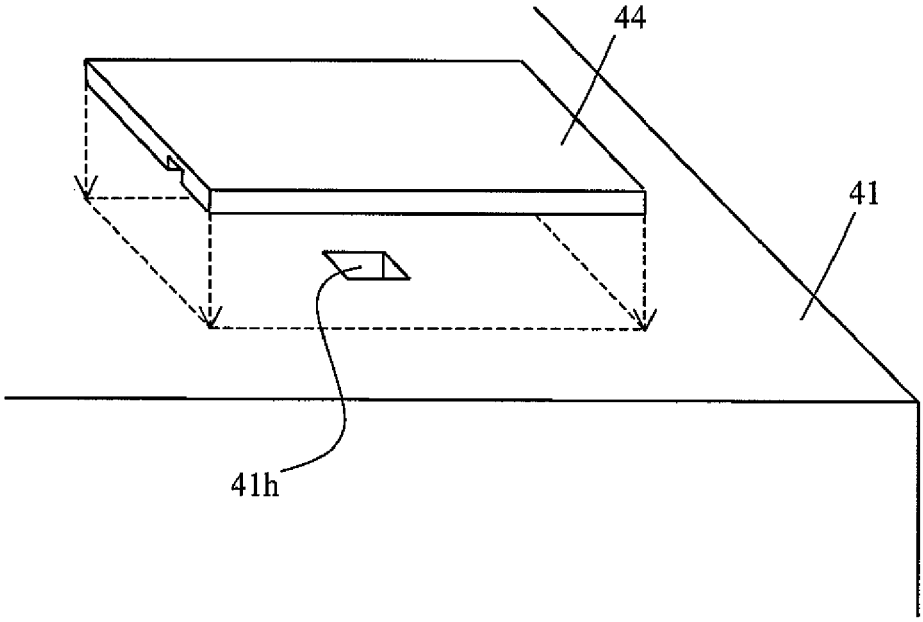
FIG. 18 is a diagram showing a manner of fixing the planar material 44 to the cabinet 41.

Further, the planar material 43 having the through-hole 43*h* may be replaced with a planar material 44 without having the through-hole 43*h*, as shown in FIGS. 17 and 18. FIG. 17 is a perspective view of the planar material 44, and shows a manner of fixing the planar material 44 to the cabinet 41. FIG. 17 shows a surface of the planar material 44, which is fixed to the cabinet 41. As shown in FIGS. 17 and 18, in the planar material 44, only a channel 44*g* of a spiral shape is formed. One extremity of the channel 44*g* reaches to a side surface of the planar material 44. The planar material 44 is fixed to the top surface of the cabinet 41 such that the other extremity of the channel 44*g* is connected to the through-hole 41*h* and such that the channel 43*g* is covered with the top surface of the cabinet 41. The planar material 44 having such configuration is used, whereby it is also possible to easily form the long tubular hollow Th in the narrow area.

In FIGS. 15 to 18, the channel 43*g* is formed in a spiral shape, however, the channel 43*g* may be formed in another shape such as a meander shape.

Embodiment 5

Figure 19:
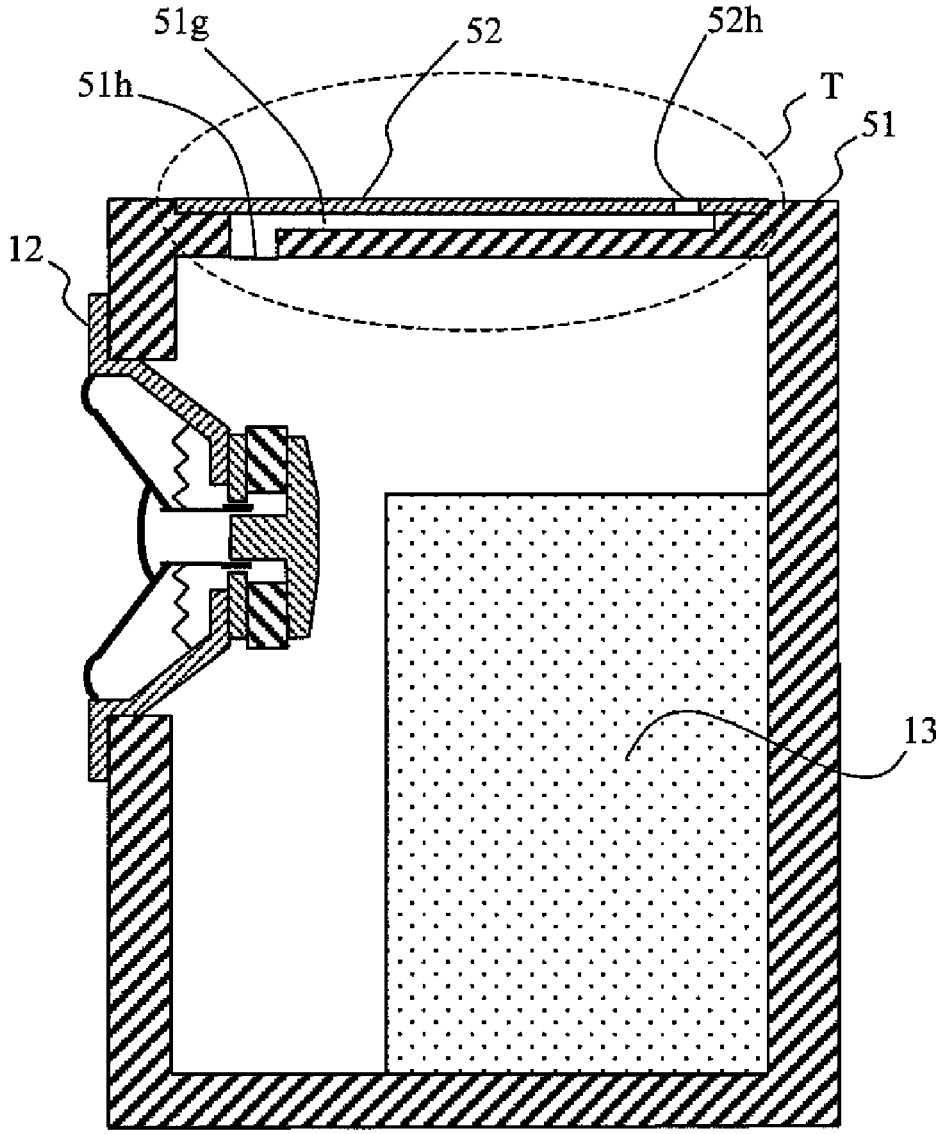
FIG. 19 is a tectonic profile of a speaker system according to embodiment 5 of the present invention.

FIG. 19 is a tectonic profile of a speaker system according to embodiment 5 of the present invention. As shown in FIG. 19, the speaker system is the closed-type speaker system, and includes a cabinet 51, the speaker unit 12, the gas adsorbent 13, and a planar material 52. The speaker system according to the present embodiment is different from the speaker system shown in FIG. 1 in that the cabinet 51 is used in replacement of the cabinet 11, and the planar material 52 is further included. Further, the tubular structure T is configured with the cabinet 51 and the planar material 52. Hereinafter, the different points will be mainly described.

Figure 20:
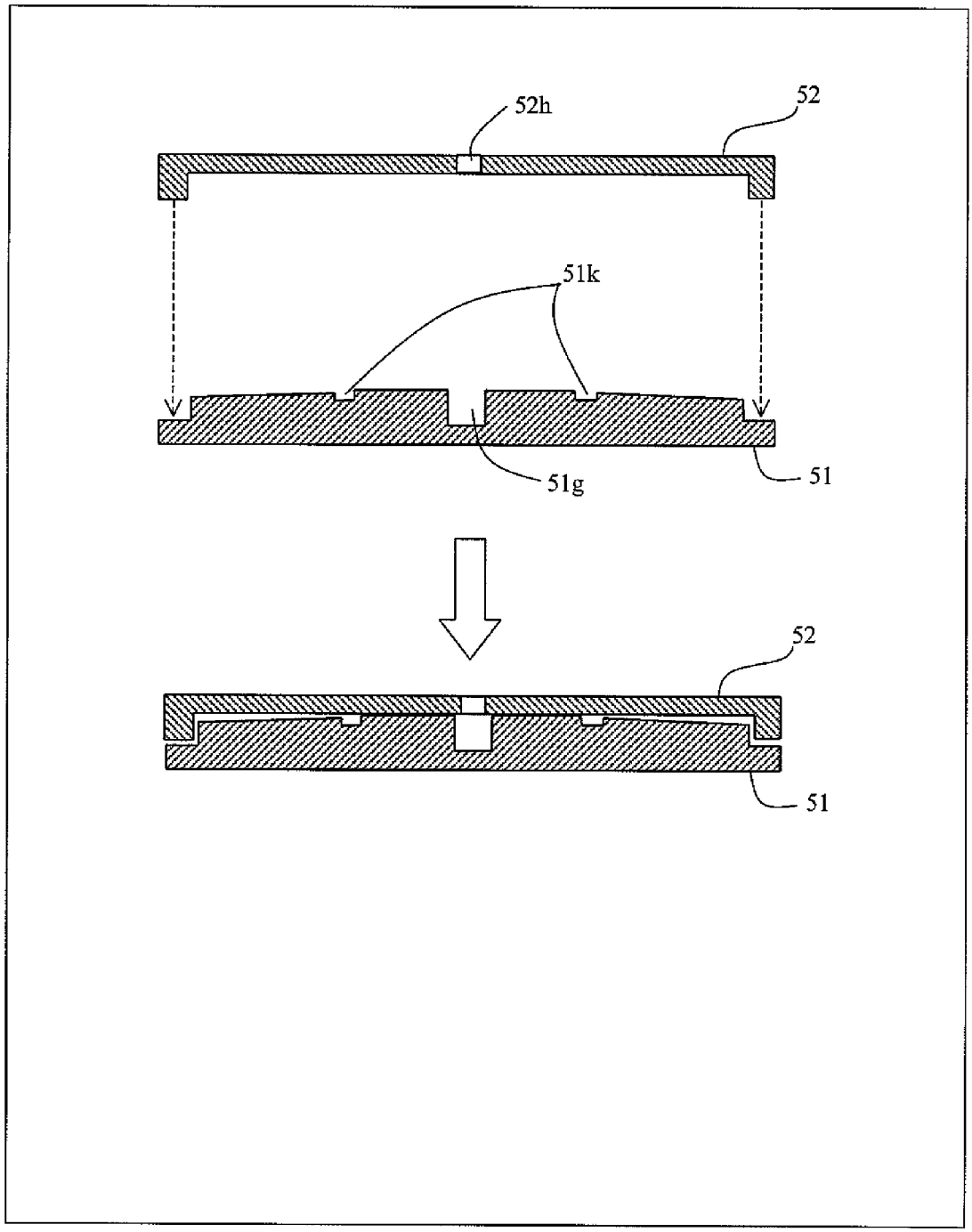
FIG. 20 is a diagram showing a manner of fixing a planar material 52 to a cabinet 51 as viewed from a front side of the cabinet 51.

The speaker unit 12 is fixed to the cabinet 51, and the cabinet 51 is made from the moisture-impermeable material. As shown in FIGS. 19 and 20, in the cabinet 51, formed are a channel 51*g* and channels 51*k* which are each of a linear shape, and a through-hole 51*h* which is situated at one extremity of the channel 51*g*. As shown in FIG. 20, a top surface of the cabinet 51 is slightly convex upward. FIG. 20 is a diagram showing a manner of fixing the planar material 52 to the cabinet 51, as viewed from a front side of the cabinet 51.

As shown in FIGS. 19 and 20, in the planar material 52, a through-hole 52*h* is formed. As shown in FIG. 20, the planar material 52 is fixed on the top surface of the cabinet 51, as indicated by dotted arrows, such that the other extremity of the channel 51*g* is connected to the through-hole 52*h*, and such that the channel 51*g* is covered with the planar material 52. Accordingly, the through-hole 51*h*, the channel 51*g* and the through-hole 52*h* are connected to one another, and whereby the tubular hollow Th is formed. The tubular hollow Th is set to satisfy equation (6).

As above described, in the present embodiment, tubular structure T, which has the tubular hollow Th whose length and effective radius satisfy equation (6), is configured with the cabinet 51 and the planar material 52. Further, the speaker unit 12 is configured with the moisture-proof component parts. Accordingly, in the same manner as embodiment 1, it is possible to minimize the moisture flowing from the outside to the inside of the cabinet 51 which has the gas adsorbent 13 situated thereinside.

In the present embodiment, the channels 51*k* are formed in the cabinet 51 and the top surface of the cabinet 51 is convex. Therefore, when the planar material 52 is fixed to the top surface of the cabinet 51 with the adhesive agent, the excess adhesive agent flows into air gaps formed between the cabinet 51 and the planar material 52, and is likely to flow to an outer side of the channels 51*k* on the cabinet 51, instead of an inner side of the cabinet 51, where the channel 51*g* is situated.

Accordingly, it is possible to prevent the tubular hollow Th from being filled with the adhesive agent.

In the above description, the channel 51*g* is of a linear shape as viewed from the top surface side of the cabinet 51, but may be formed in a spiral shape. Alternatively, the channel 51*g* may be formed in another shape such as a meander shape. In the above description, the channels 51*k* are formed in the cabinet 51, but are not limited thereto. The channels 51*k* may be formed in the planar material 52.

Embodiment 6

Figure 21:
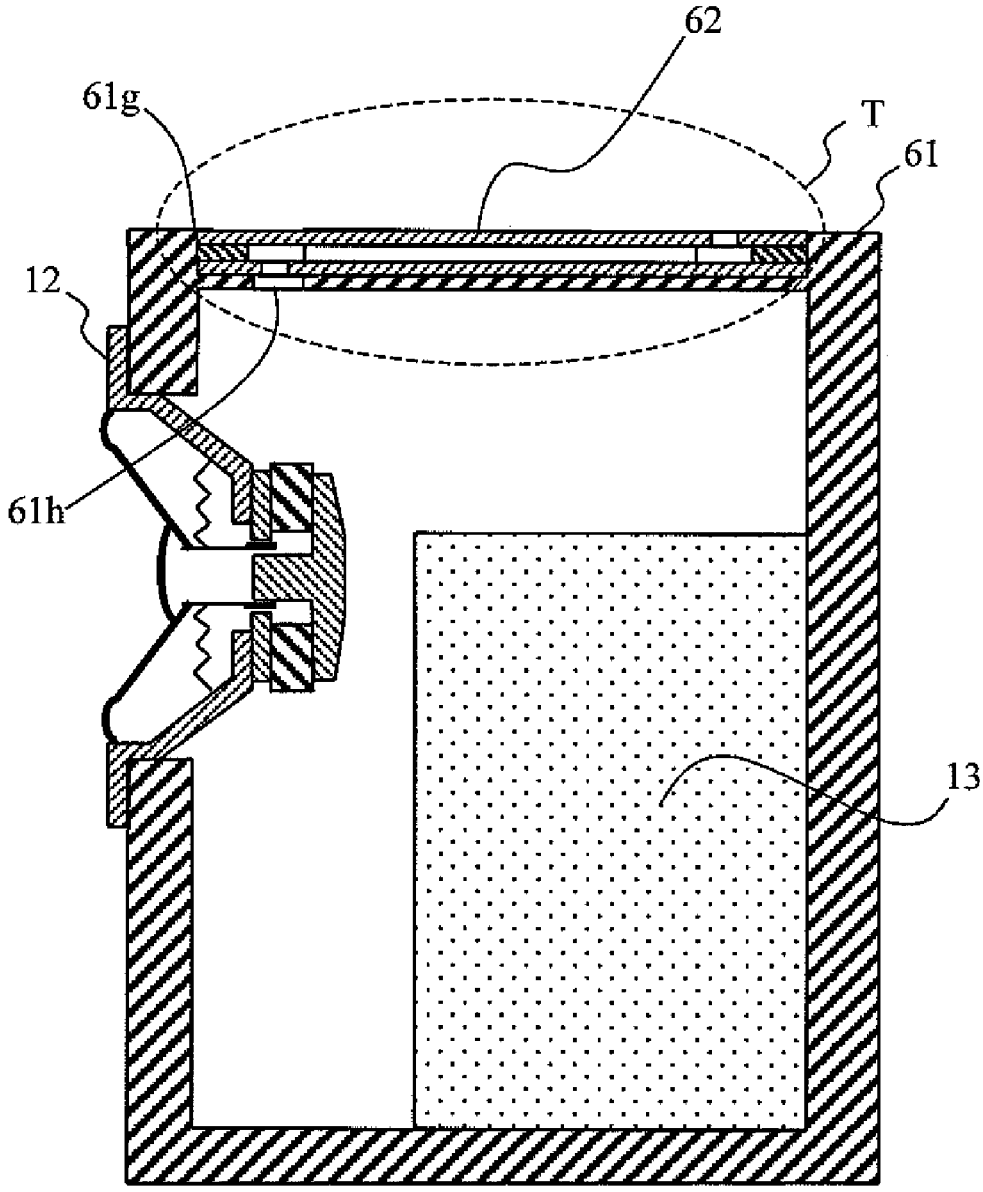
FIG. 21 is a tectonic profile of a speaker system according to embodiment 6 of the present invention.

FIG. 21 is a tectonic profile of a speaker system according to embodiment 6 of the present invention. As shown in FIG. 21, the speaker system is the closed-type speaker system, and includes a cabinet 61, the speaker unit 12, the gas adsorbent 13 and a planar mechanism 62. The speaker system according to the present embodiment is different from the speaker system shown in FIG. 1 in that the cabinet 61 is used in replacement of the cabinet 11, and the planar mechanism 62 is further included. Further, the tubular structure T is configured with the cabinet 61 and the planar mechanism 62. Hereinafter, the different points will be mainly described.

The speaker unit 12 is fixed to the cabinet 61, and the cabinet 61 is made from the moisture-impermeable material. In the cabinet 61, a channel 61*g* and a through-hole 61*h* are formed.

Figure 22:
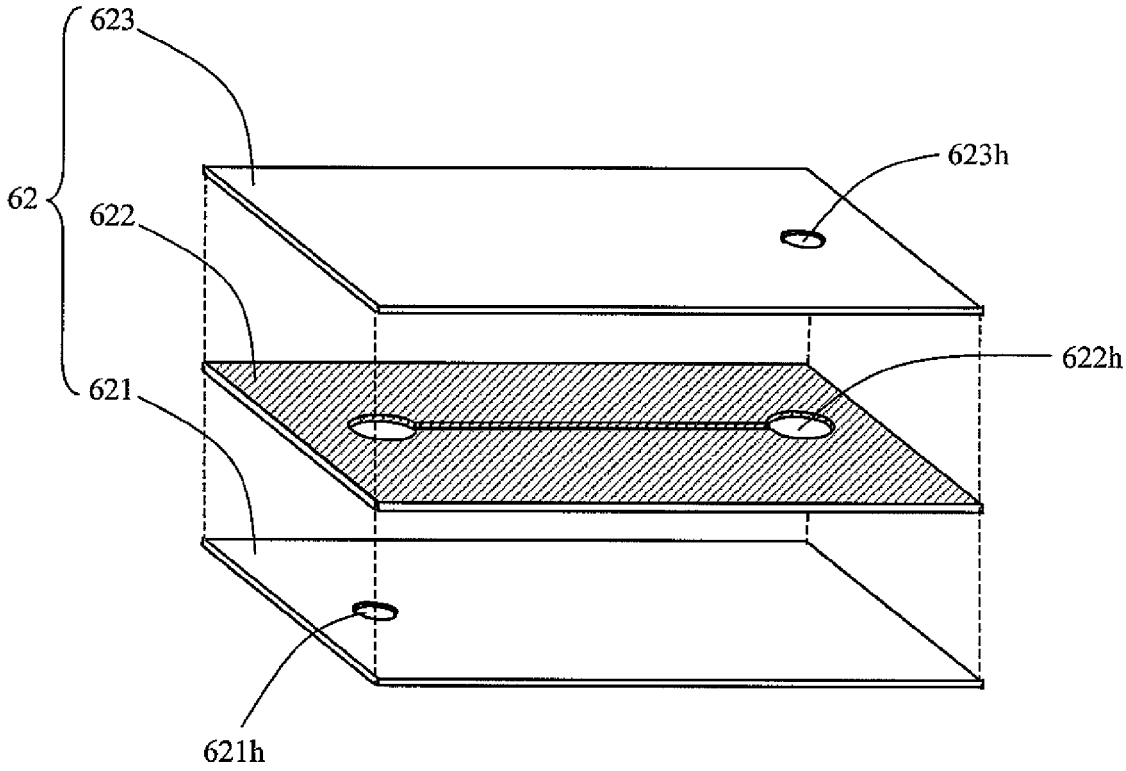
FIG. 22 is an exploded diagram of a planar mechanism 62.

The planar mechanism 62 is embedded into the channel 61*g* of the cabinet 61, and as shown in FIG. 22, the planar mechanism 62 includes a first planar material 621, an elastic material 622, and a second planar material 623. FIG. 22 is an exploded diagram of the planar mechanism 62. The first planar material 621 has a through-hole 621*h* formed at a position connectable to the through-hole 61*h* of the cabinet 61. The elastic material 622 has a through-hole 622*h*, which is of a linear shape. The elastic material 622 is fixed on a top surface of the first planar material 621 such that one extremity of the through-hole 622*h* is connected to the through-hole 621*h* and such that a lower opening of the through-hole 622*h* is covered with the top surface of the first planar material 621. The second planar material 623 has a through-hole 623*h*. The second planar material 623 is fixed on a top surface of the elastic material 622 such that the through-hole 623*h* is connected to the other extremity of the through-hole 622*h*, and such that an upper opening of the through-hole 622*h* is covered with the second planar material 623. The first planar material 621 and the second planar material 623 are fixed to each other with screws or fastening hardware so as to compress the elastic material 622. With the above-described structure, the through-hole 61*h* is connected to the through-holes 621*h* to 623*h*, whereby the tubular hollow Th is formed. The tubular hollow Th is set to satisfy equation (6).

As above described, in the present embodiment, the tubular structure T, which has the tubular hollow Th whose length and effective radius satisfy equation (6), is configured with the cabinet 61 and the planar mechanism 62. Further, the speaker unit 12 is configured with the moisture-proof component parts. Accordingly, in the same manner as the embodiment 1, it is possible to minimize the moisture flowing from the outside to the inside of the cabinet 61 which has the gas adsorbent 13 situated thereinside.

In the present embodiment, the first planar material 621 and the second planar material 623 are fixed with the screws or the fastening hardware. Therefore the adhesive agent is not required, and thus it is possible to prevent the adhesive agent from entering into the tubular hollow Th.

In the above description, the first planar material 621 and the second planar material 622 are fixed with the screws or the fastening hardware. However, in order to prevent, in a secured manner, the air from leaking from between the first planar material 621 and elastic material 622 or between the elastic material 622 and the second planar material 623, a sealing material or the adhesive agent may be applied there between.

Figure 23:
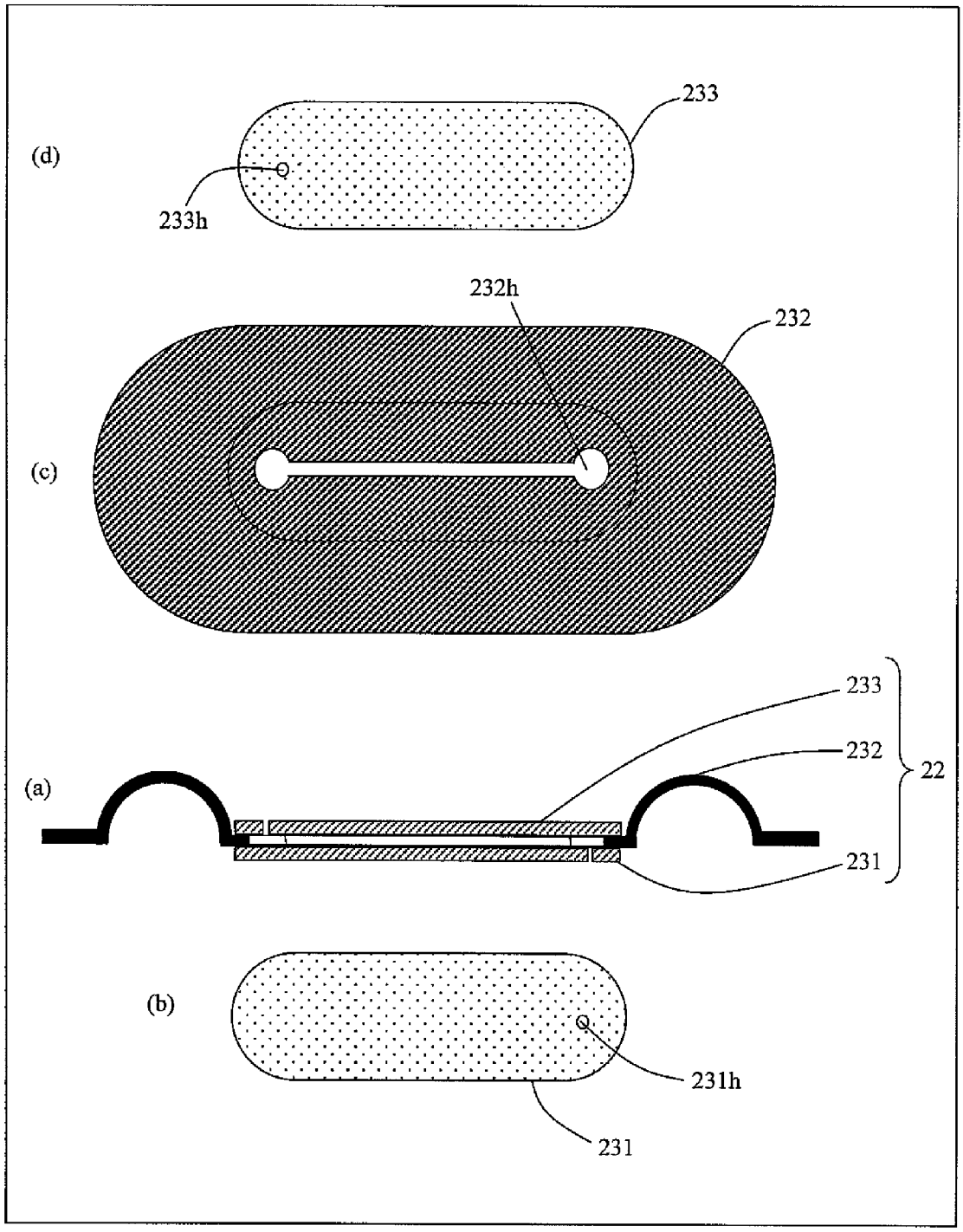
FIG. 23 is a diagram showing a structure in the case where the planar mechanism 62 is applied to the drone cone 22 described in embodiment 2.

The above-described planar mechanism 62 may be applied to the drone cone 22 described in embodiment 2. FIG. 23 is a diagram showing a structure in the case where the planar mechanism 62 is applied to the drone cone 22 described in embodiment 2. FIG. 23 is a diagram showing, in detail, a structure of the drone cone 22. FIG. 23(*a*) is a tectonic profile of the drone cone 22. FIG. 23(*b*) is a diagram of a first diaphragm 231 shown in FIG. 23(*a*) as viewed from an upper side thereof. FIG. 23(*c*) is a diagram of an edge 232 shown in FIG. 23(*a*) as viewed from an upper side thereof. FIG. 23(*d*) is a diagram of a second diaphragm 233 shown in FIG. 23(*a*) as viewed from an upper side thereof.

The drone cone 22 includes the first diaphragm 231, the edge 232 and the second diaphragm 233. These component parts are each made from the moisture-impermeable material. In the first diaphragm 231, a through-hole 231*h* is formed. In the edge 232, a through-hole 232*h*, which is of a linear shape, is formed. The edge 232 is fixed on a top surface of the first diaphragm 231 such that one extremity of the through-hole 232*h* is connected to the through-hole 231*h* and such that a lower opening of the through-hole 232*h* is covered with the first diaphragm 231. In the second diaphragm 233, a through-hole 233*h* is formed. The second diaphragm 233 is fixed on a top surface of the edge 232 such that the through-hole 233*h* is connected to the other extremity of the through-hole 232*h* and such that an upper opening of the through-hole 232*h* is covered with the second diaphragm 233. In this manner, the planar mechanism 62 is applied to the drone cone 22, whereby it is possible to easily form the tubular hollow Th without using extra component parts. Further, it is possible to prevent an acoustic loss caused by the extra component parts.

In the above description, each of the through-hole 621*h* and the through-hole 232*h* is of the linear shape, but may be of a curved shape or of a spiral shape. In the case where each of the through-hole 621*h* and the through-hole 232*h* is of the curved shape or of the spiral shape, the length of the tubular hollow Th is longer than that in the case of the linear shape. Further, in order to obtain a higher viscous resistance in the tubular hollow Th, inner surfaces of the through-hole 621*h* and the through-hole 232*h* may have a convex and concave shape.

Embodiment 7

Figure 24:
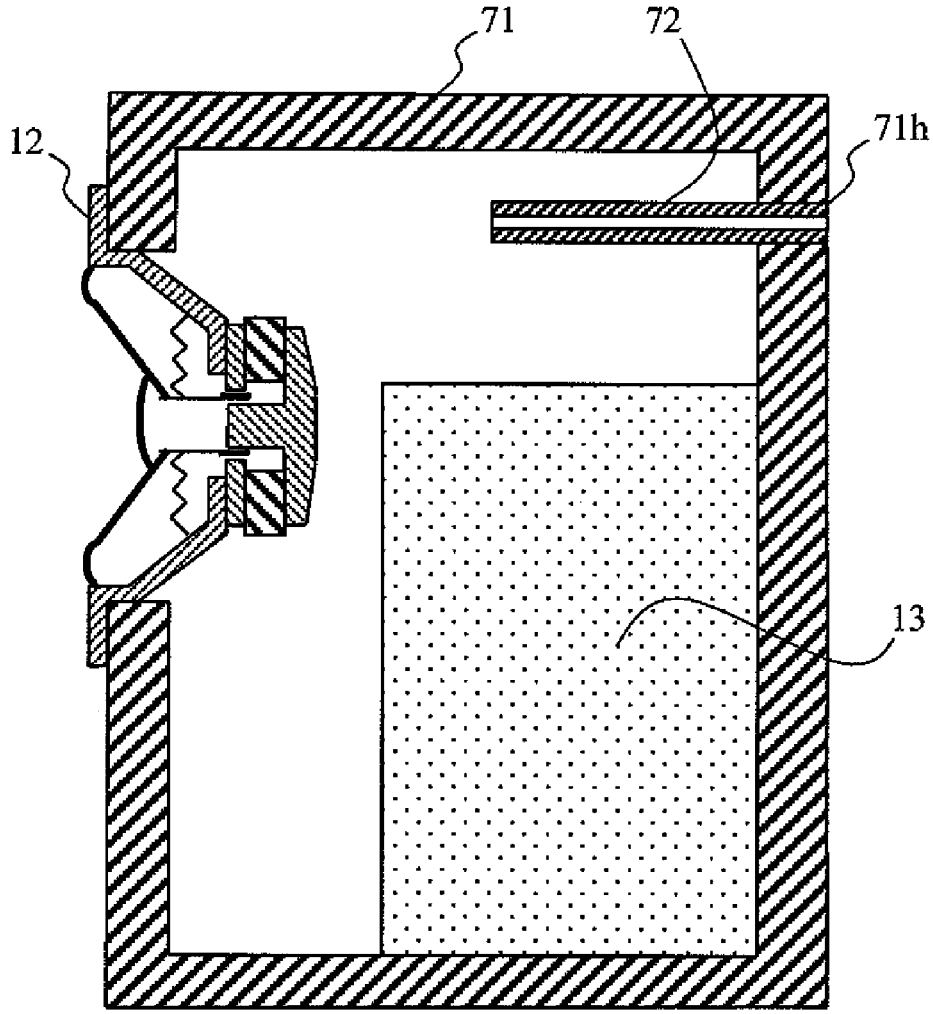
FIG. 24 is a tectonic profile of a speaker system according to embodiment 7 of the present invention.

FIG. 24 is a tectonic profile of a speaker system according to embodiment 7 of the present invention. As shown in FIG. 24, the speaker system is the closed-type speaker system, and includes a cabinet 71, the speaker unit 12, the gas adsorbent 13 and a tubular material 72. The speaker system according to the present embodiment is different form the speaker system shown in FIG. 1 in that the cabinet 71 is used in replacement of the cabinet 11, and the tubular material 72 is further included. Further, the tubular structure T is configured with the tubular material 72. Hereinafter, the different points will be mainly described.

The speaker unit 12 is fixed to the cabinet 71, and the cabinet 71 is made from the moisture-impermeable material. In the cabinet 71, a through-hole 71*h* is formed.

The tubular material 72 is configured with a silicone tube, a rubber tube, a plastic tube, a metal pipe and the like, for example. The tubular material 72 is inserted in the through-hole 71*h*, and the tubular material 72 has the tubular hollow Th formed thereinside. The length and the effective radius of the tubular hollow Th are set to satisfy equation (6).

As above described, in the present embodiment, the tubular structure T, which has the tubular hollow Th whose length and effective radius satisfy equation (6), is configured with the tubular material 72. Further, the speaker unit 12 is configured with the moisture-proof component parts. Accordingly, in the same manner as embodiment 1, it is possible to minimize the moisture flowing from the outside to the inside of the cabinet 71 which has the gas adsorbent 13 situated thereinside.

Further, in the present embodiment, the tubular hollow Th may be formed only with the tubular material 72. Accordingly, the narrow through-hole 11*h* as described in embodiment 1 does not need to be formed, and thus it is possible to form the tubular hollow Th easily. Further, in the case where the tubular material 72 is configured with the silicone tube or the like, the tubular material 72 is bent so as not to block the inside of the tubular material 72. Accordingly, it is possible to easily form the tubular hollow Th which satisfy equation (6) even if the cabinet 71 is of a small size.

Figure 25:
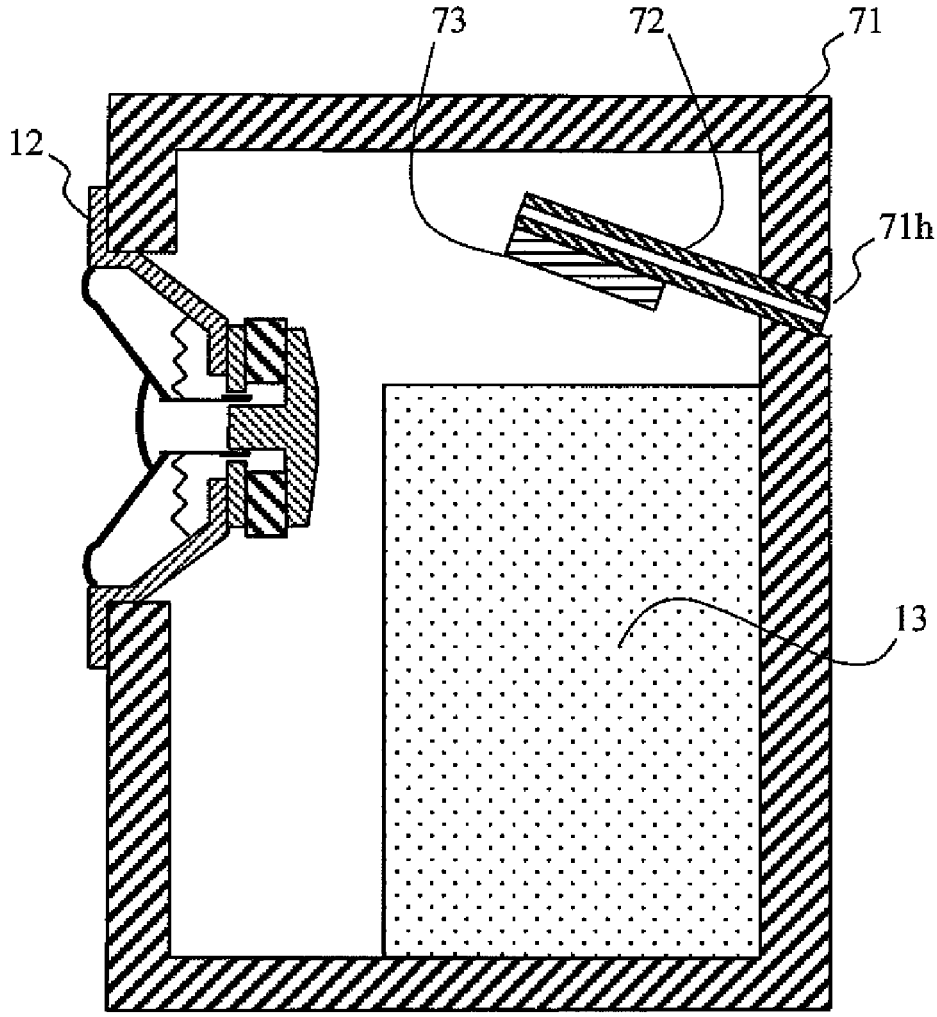
FIG. 25 is a tectonic profile of the speaker system including a cooling section 73.

The speaker system according to the present may further includes a cooling section 73, as shown in FIG. 25. FIG. 25 is a tectonic profile of the speaker system which includes the cooling section 73. In FIG. 25, the tubular material 72 is configured with the metal pipe. The tubular material 72 is fixed to the cabinet 71 in an inclined manner such that an opening of the tubular material 72 situated inside the cabinet 71 is located at a higher position than the other opening of the tubular material 72 situated at an outside wall surface of the cabinet 71. The cooling section 73 is fixed to the tubular material 72 so as to cool the tubular material 72. The cooling section 73 may have any configuration as long as the cooling section 73 is capable of lowering the temperature of the tubular material 72 than the ambient temperature. The cooling section 73 may be configured with a peltiert device, or may be configured so as to include water thereinside.

When the above-described cooling section 73 is used, the air passing through the tubular material 72 is cooled locally. Therefore, the moisture flowing from the outside of the cabinet 71 is liquefied into water in the tubular material 72. The water in the tubular material 72 is drained from the opening of the tubular material 72 situated at the outside wall surface of the cabinet 71 to the outside of the cabinet 71. Accordingly, an absolute quantity of the moisture included in the air passing through the tubular material 72 can be reduced, whereby it is possible to prevent a performance degradation of the gas adsorbent 13, the deterioration being caused by the moisture absorption.

The inside of the tubular material 72 may be of a honeycomb structure. In this case, it is possible to efficiently cool the air passing through the tubular material 72. Further, a reservoir (not shown) may be fixed outside the cabinet 71 so as to store the water drained from the opening of the tubular material 72 situated at the outside wall surface of the cabinet 71. In this case, the reservoir is demountable from the cabinet 71, preferably.

Embodiment 8

Figure 26:
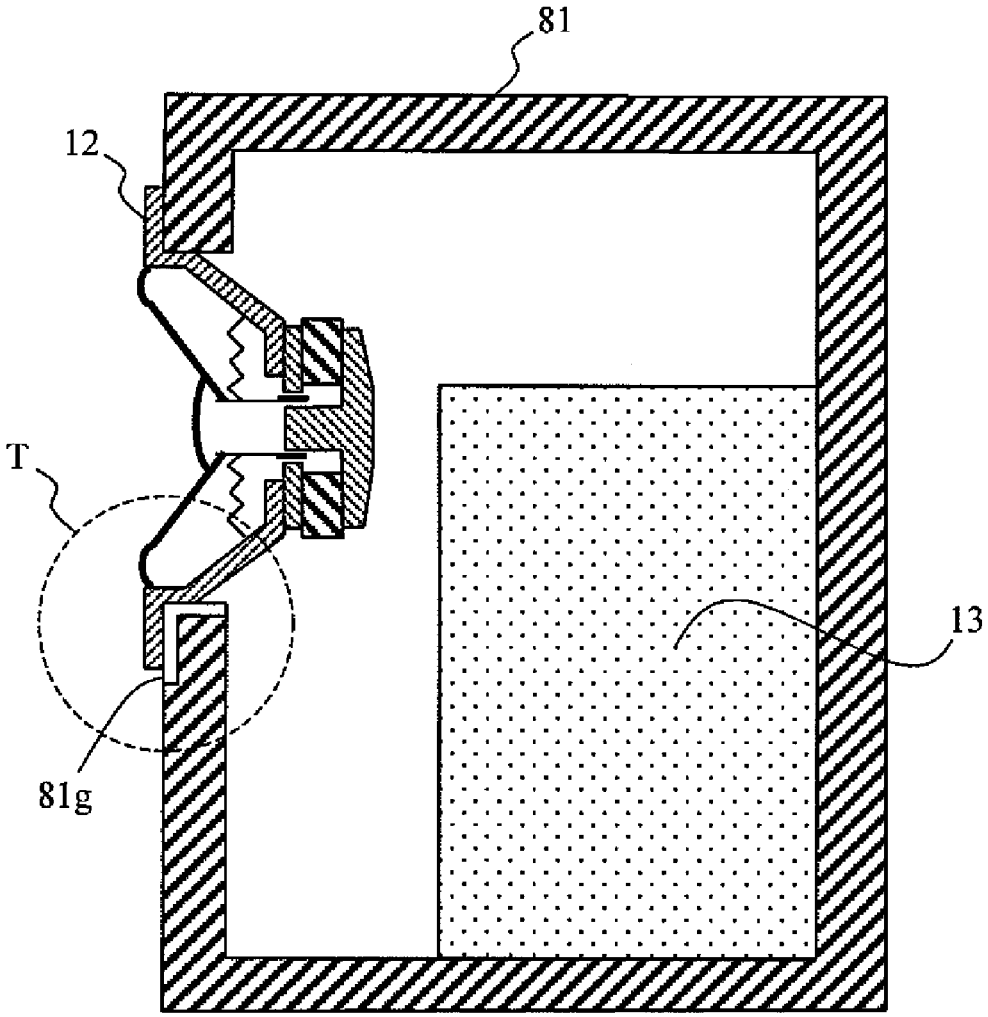
FIG. 26 is a tectonic profile of a speaker system according to embodiment 8 of the present invention.

FIG. 26 is a tectonic profile of a speaker system according to embodiment 8 of the present invention. As shown in FIG. 26, the speaker system is the closed-type speaker system, and includes a cabinet 81, the speaker unit 12 and the gas adsorbent 13. The speaker system according to the present embodiment is different from the speaker system shown in FIG. 1 in that the cabinet 81 is used in replacement of the cabinet 11, and the tubular structure T is configured with the cabinet 81 and the speaker unit 12. Hereinafter, the different points will be mainly described.

The speaker unit 12 is fixed to the cabinet 81, and the cabinet 81 is made from the moisture-impermeable material. A channel 81*g* is formed in the cabinet 81 at a position in contact with the speaker unit 12. The tubular hollow Th is formed between the channel 81*g* and the speaker unit 12. The length and the effective radius of the tubular hollow Th are set to satisfy equation (6).

As above described, in the present embodiment, the tubular structure T, which has the tubular hollow Th whose length and effective radius satisfy equation (6), is configured with the cabinet 81 and the speaker unit 12. Further, the speaker unit 12 is configured with the moisture-proof component parts. Accordingly, in the same manner as the embodiment 1, it is possible to minimize the moisture flowing from the outside to the inside of the cabinet 81 which has the gas adsorbent 13 situated thereinside.

Figure 27:
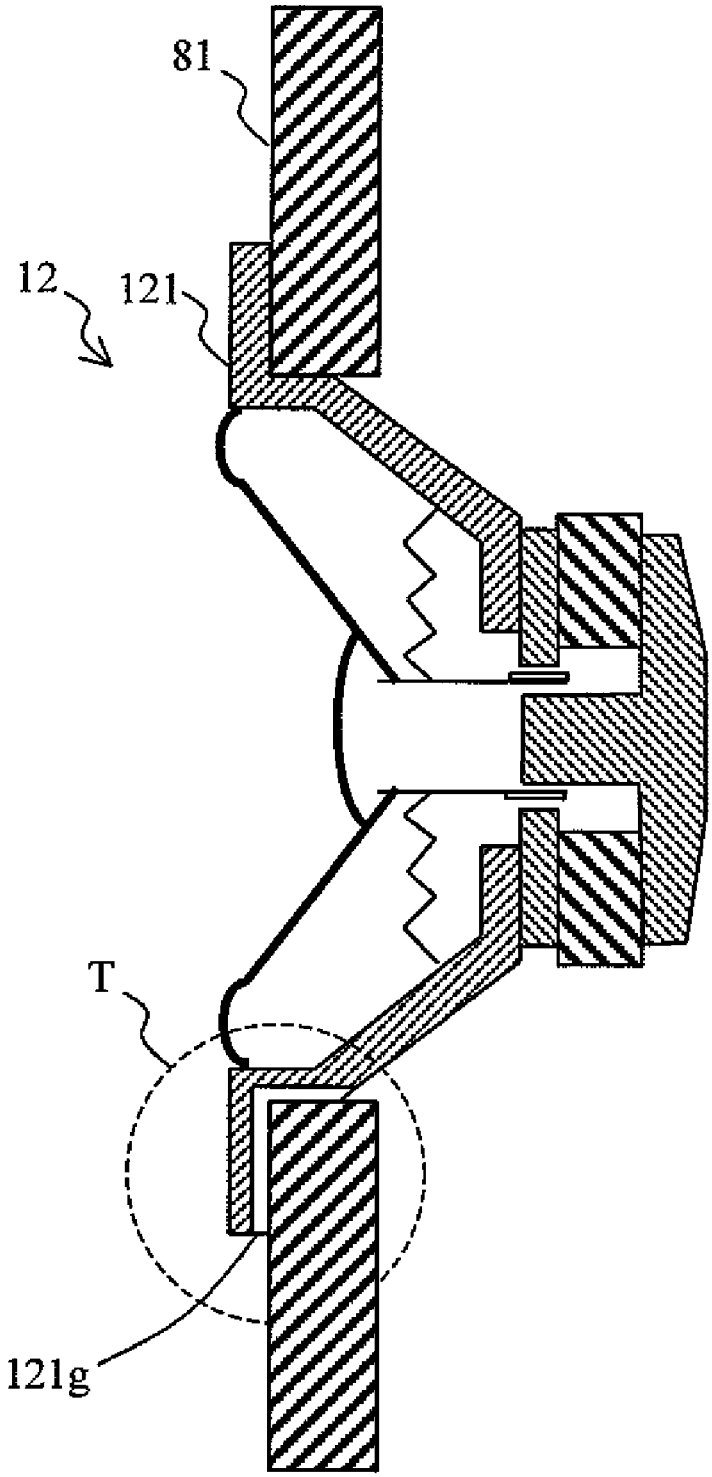
FIG. 27 is a diagram showing a portion where the speaker unit 12 having a channel 121*g* is fixed to a cabinet 81.

In the above description, the channel 81*g* is formed in the cabinet 81. However, as shown in FIG. 27, a channel 121*g* may be formed in a frame 121 of the speaker unit 12. FIG. 27 is a diagram showing a portion where the speaker unit 12 having a channel 121*g* is fixed to a cabinet 81. In this case, the tubular structure T is configured with the speaker unit 12 having the channel 121*g* and the cabinet 81, and the tubular hollow Th is formed between the channel 121*g* and the cabinet 81.

Embodiment 9

In the present embodiment, exemplary cases will be described where the above-described speaker system of the present invention is applied to a portable terminal apparatus, which is typified by a mobile phone, a vehicle, and an audio-visual apparatus, which is typified by a television.

Figure 28:
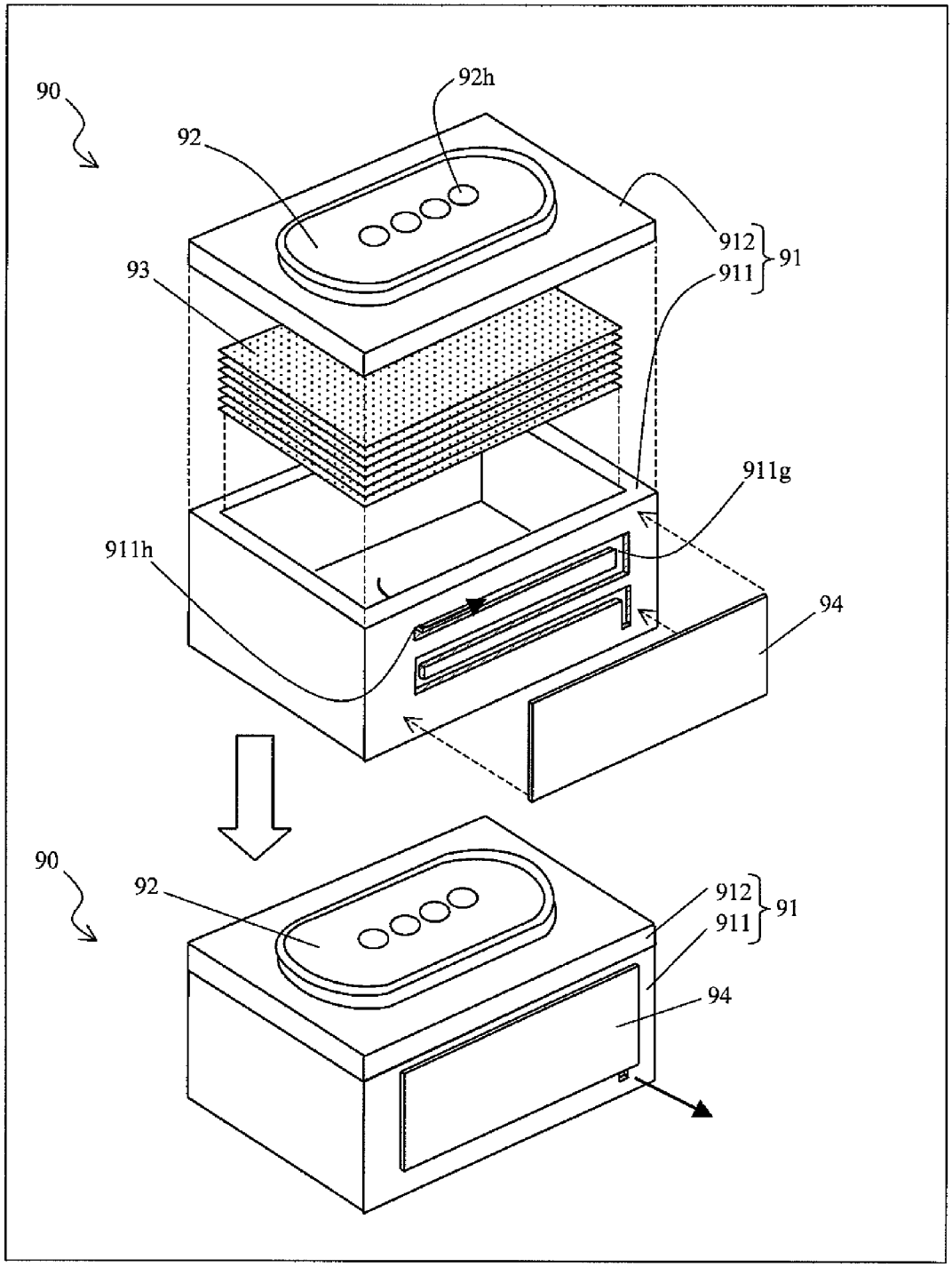
FIG. 28 is a tectonic profile of a speaker system which is mounted in a mobile phone.

First, a speaker system mounted in the portable terminal apparatus such as the mobile phone will be described specifically. FIG. 28 is a tectonic profile of the speaker system mounted in the mobile phone. As shown in FIG. 28, the speaker system 90 is the closed-type speaker system, and includes a cabinet 91, a speaker unit 92, a gas adsorbent 93, and a planar material 94. The cabinet 91 is configured with a housing 911 and a baffle plate 912. The housing 911 has a box structure whose one side is open. The housing 911 is made from the moisture-impermeable material such as the resin and the metal. In the housing 911, formed are a channel 911*g* and a through-hole 911*h* situated at one extremity of the channel 911*g*. The baffle plate 912 is made from the moisture-impermeable material such as the resin and the metal, and fixed to the housing 911 so as to seal the open one side of the housing 911. The speaker unit 92 is configured with the moisture-proof component parts such as the diaphragm and the edge, which are each made from the moisture-permeable material, and is fixed to the baffle plate 912. A sound is emitted from sound holes 92*h*. The gas adsorbent 93 is made from the same material as the above-described gas adsorbent 13, and is situated inside the housing 91.

The planar material 94 is fixed to a side surface of the housing 911, on which channel 911*g* is formed, so as not to cover the other extremity of the channel 911*g*. With this structure, the tubular hollow Th is formed by the through-hole 911*h* and the channel 911*g*, and the air moves through the tubular hollow Th as indicated by a solid arrow. The length and the effective radius of the tubular hollow Th are set to satisfy equation (6).

As above described, the tubular structure T, which has the tubular hollow Th whose length and effective radius satisfy equation (6), is configured with the cabinet 91 and the planar material 94. Further, the speaker unit 12 is configured with the moisture-proof component parts. Accordingly, in the same manner as embodiment 1, it is possible to minimize the moisture flowing from the outside to the inside of the cabinet 91 which has the gas adsorbent 93 situated thereinside.

Figure 29:
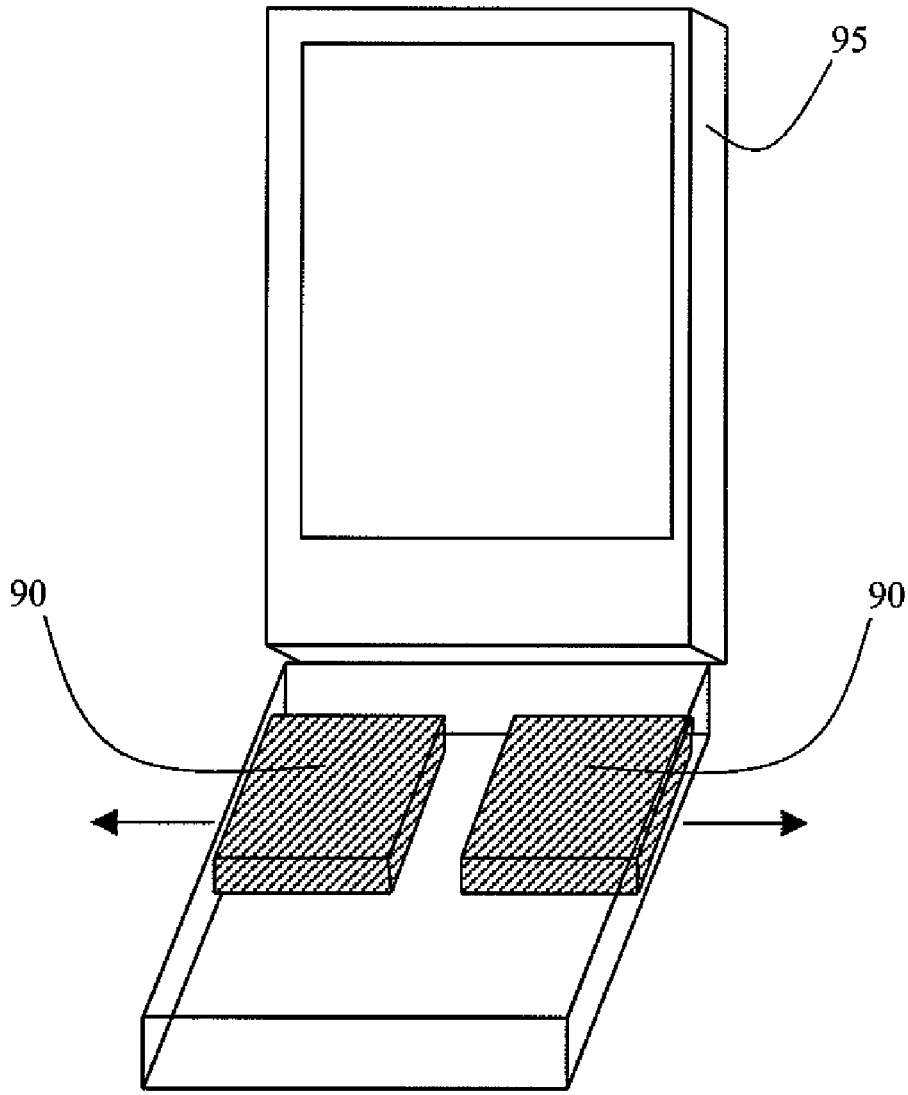
FIG. 29 is a diagram showing a mobile phone in which the speaker systems 90 shown in FIG. 28 are mounted.

FIG. 29 is a diagram showing speaker systems 90 mounted in a mobile phone. In an example shown in FIG. 29, two speaker systems 90 are situated inside a lower housing of the mobile phone 95. Solid arrows shown in FIG. 29 correspond to the solid arrow shown in FIG. 28. The speaker system 90 may be situated inside an upper housing of the mobile phone 95, or only one speaker system 90 may be situated.

In many cases, the speaker system mounted in the mobile phone 95 is configured with the speaker unit 92 and the baffle plate 911 only. In this case, however, it is difficult to stably ensure a volumetric capacity at a backside of the speaker unit 92, and the sound quality is not stabilized. Therefore, the housing 911 is provided as shown in FIG. 28, whereby the sound quality can be stabilized.

Since downsizing of the mobile phone 95 is essential, an internal capacity of the housing of the mobile phone 95 in which the speaker system is mounted is small. Therefore, it is difficult to form a narrow and accurate channel 911*g* in the housing 911 due to limits of accuracy of a die for resin molding. However, the tubular hollow Th satisfying equation (6) may be formed by elongating the channel 911*g* while ensuring a width of the channel 911*g* to some extent.

In FIG. 29, the other extremity of the channel 911*g* which is not covered with the planar material 94 is oriented toward the outside of the mobile phone 95. However, the channel 911*g* may be oriented toward the inside of the mobile phone 95. In this case, in order to prevent the moisture from entering from the other extremity of the channel 911*g*, a structure included in the mobile phone 95 may be used. Alternatively, the other extremity of the channel 911*g* may be situated in the vicinity of a heating component situated inside the mobile phone 95. In this case, a saturated water vapor content around the other extremity of the channel 911*g* increases, and thus the moisture inside the cabinet 91 is easily discharged to the outside of the cabinet 91.

Further, the other extremity of the channel 911*g* may be covered with a cloth or paper. Alternatively, the other extremity of the channel 911*g* may be covered with a punching net which is made from the metal or the resin and which has at least one through-hole. Still alternatively, the other extremity of the channel 911*g* may be covered with a non-woven cloth, a woven cloth, paper and the like which are breathable and water-shedding. Further, the speaker system 90 may be configured such that the other extremity of the channel 911*g* faces the same direction as the sound holes 92*h* of the speaker unit 92.

Figure 30:
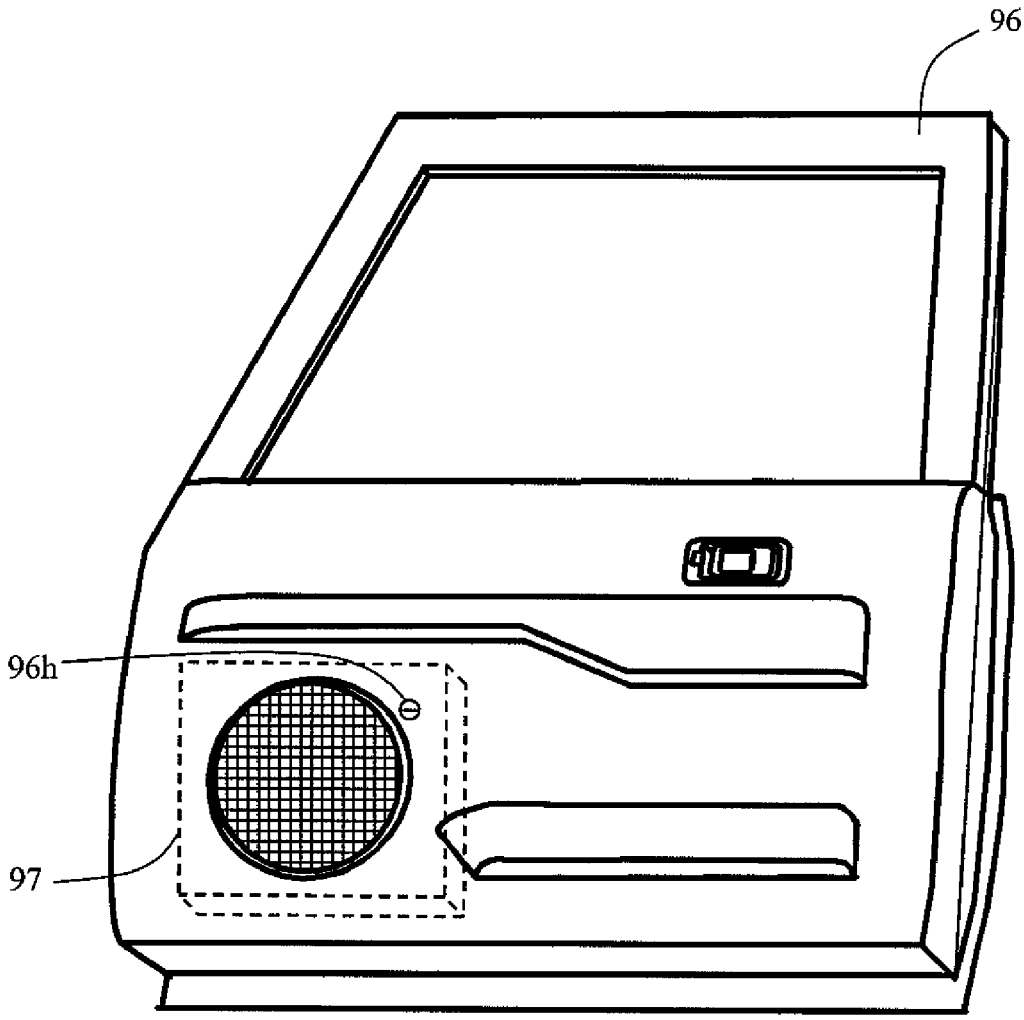
FIG. 30 is a diagram showing a vehicle door in which a speaker system is mounted.

Next, a speaker system mounted in a vehicle will be described in detail. An exemplary case will be described where the speaker system is mounted in a vehicle door. FIG. 30 is a diagram showing the speaker system mounted in the vehicle door. A speaker system 97 is situated inside a housing of a vehicle door 96. The speaker system 97 corresponds to the speaker system according to any of the above-described embodiments. The tubular hollow Th formed by the speaker system 97 is connected to a through-hole 96*h* formed in the vehicle door 96. The through-hole 96*h* is may be covered with a material which is breathable and water-shedding.

The vehicle may be used under circumstances where the humidity level is extremely high, for example, on a raining day. Therefore, it is significantly useful to mount the speaker system of the present invention in the vehicle, the speaker system being capable of minimizing the moisture flowing therein.

Next, a speaker system mounted in an audio-visual apparatus such as a television will be described in detail. An exemplary case will be described where the speaker system is mounted in a flat-screen television.

Figure 31:
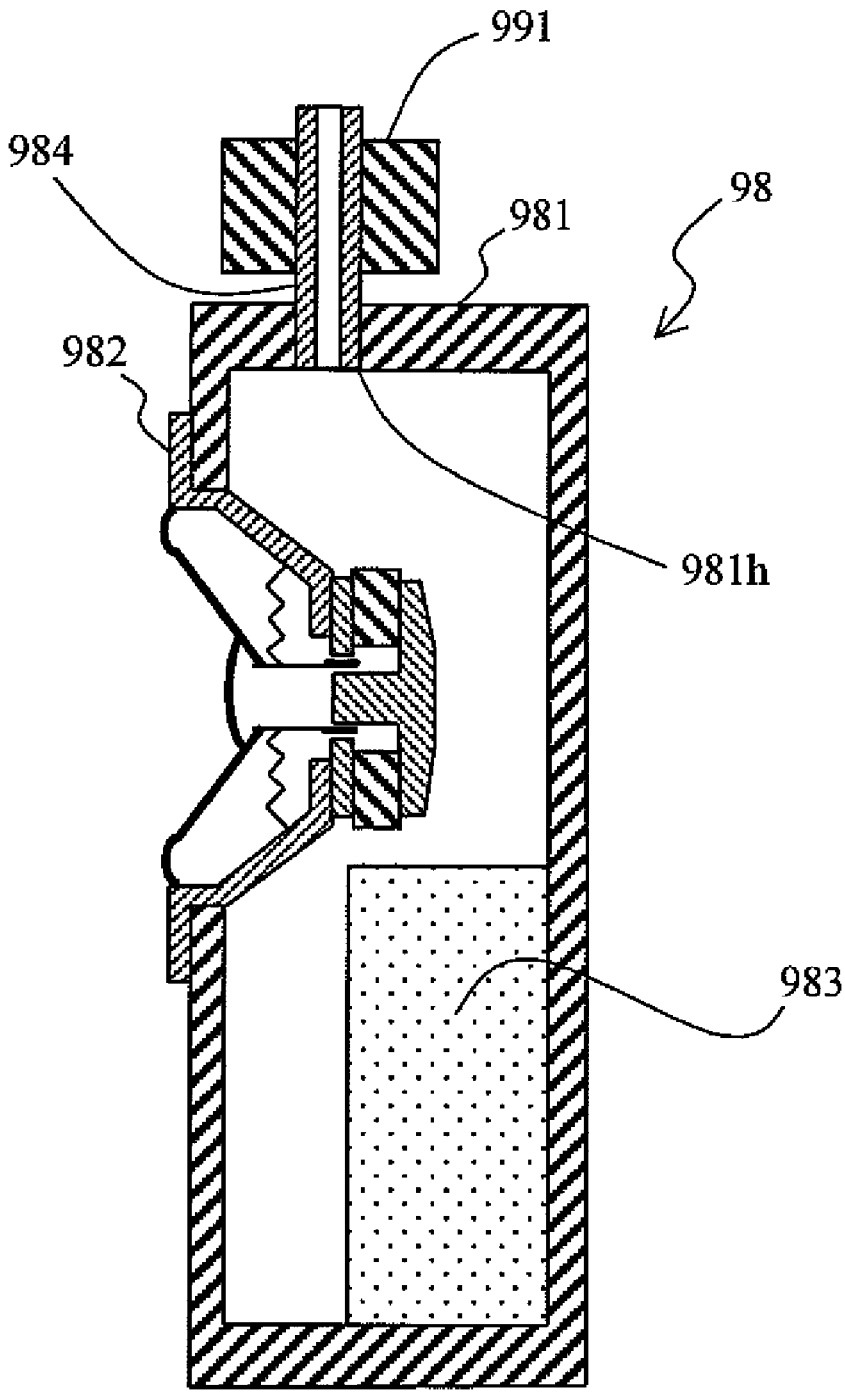
FIG. 31 is a tectonic profile of a speaker system which is mounted in a flat-screen television.
Figure 32:
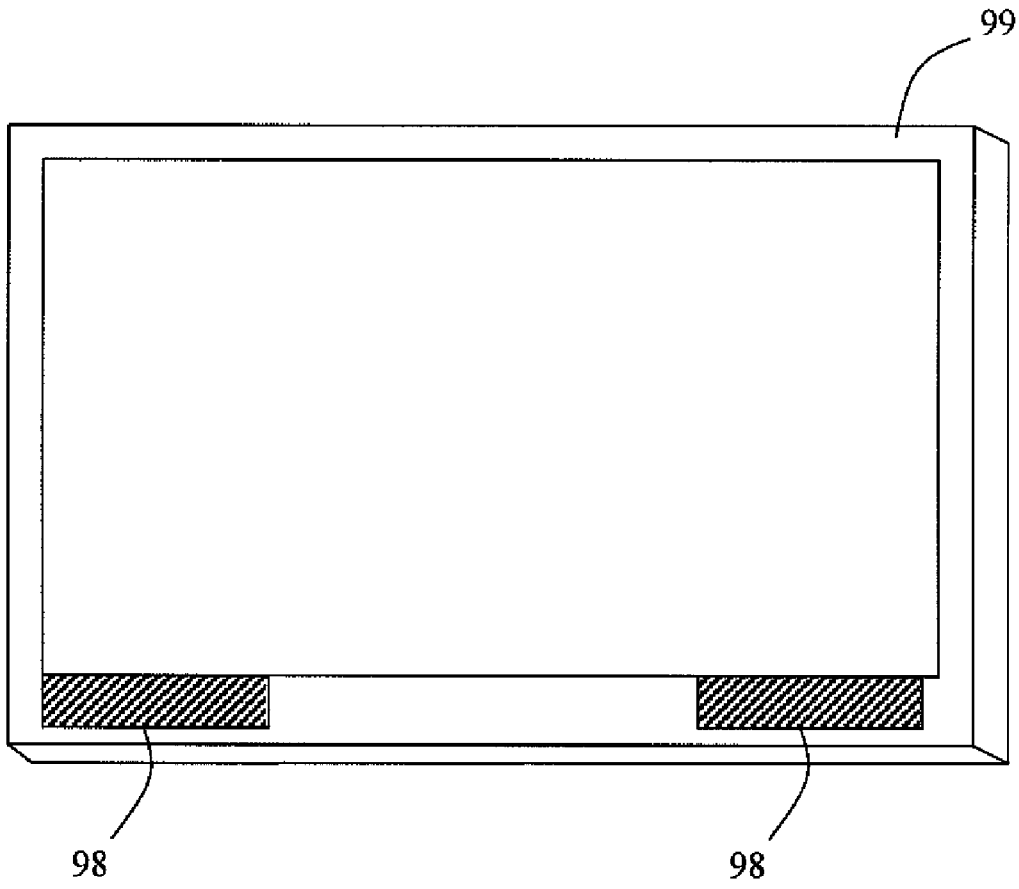
FIG. 32 is a diagram showing a flat-screen television in which the speaker systems 98 shown in FIG. 31 are mounted.

FIG. 31 is a tectonic provide of the speaker system mounted in the flat-screen television. As shown in FIG. 31, the speaker system 98 is the closed-type speaker system, and includes a cabinet 981, a speaker unit 982, a gas adsorbent 983, and a tubular material 984. As shown in FIG. 32, two speaker systems 98 are situated inside a lower housing of the flat-screen television 99. FIG. 32 is a diagram of the speaker systems 98 shown in FIG. 31 mounted in the flat-screen television.

The speaker unit 982 is fixed to the cabinet 981, and the cabinet 981 is made from the moisture-impermeable material. A through-hole 981*h* is formed on a top surface of the cabinet 981. The speaker unit 982 is configured with the moisture-proof component parts such as the diaphragm and the edge which are each made from the moisture-impermeable material. The gas adsorbent 983 is made from the same material as the above-described gas adsorbent 13, and is situated inside the cabinet 981. The tubular material 984 is configured with the silicone tube, the rubber tube, the plastic tube, the metal pipe, or the like, for example. The tubular material 984 is inserted in the through-hole 981*h*, and the tubular hollow Th is formed inside the tubular material 984. The length and the effective radius of the tubular hollow Th are set to satisfy equation (6). The tubular material 984 is situated in the vicinity of a heating component 991 inside the flat-screen television 99, or in contact with the heating component 991.

As above described, the tubular structure T, which has the tubular hollow Th whose length and effective radius satisfy equation (6), is configured with the tubular material 984. Further, the speaker unit 982 is configured with the moisture-proof component parts. Accordingly, in the same manner as embodiment 1, it is possible to minimize the moisture flowing from the outside to the inside of the cabinet 981 which has the gas adsorbent 983 situated thereinside.

A large number of heating components 991 are used in the flat-screen television 99. Therefore, by using the heating components 991, the saturated water vapor content within the tubular material 984 is increased, whereby it is possible to discharge a larger amount of moisture from the inside to the outside of the cabinet 981.

Figure 33:
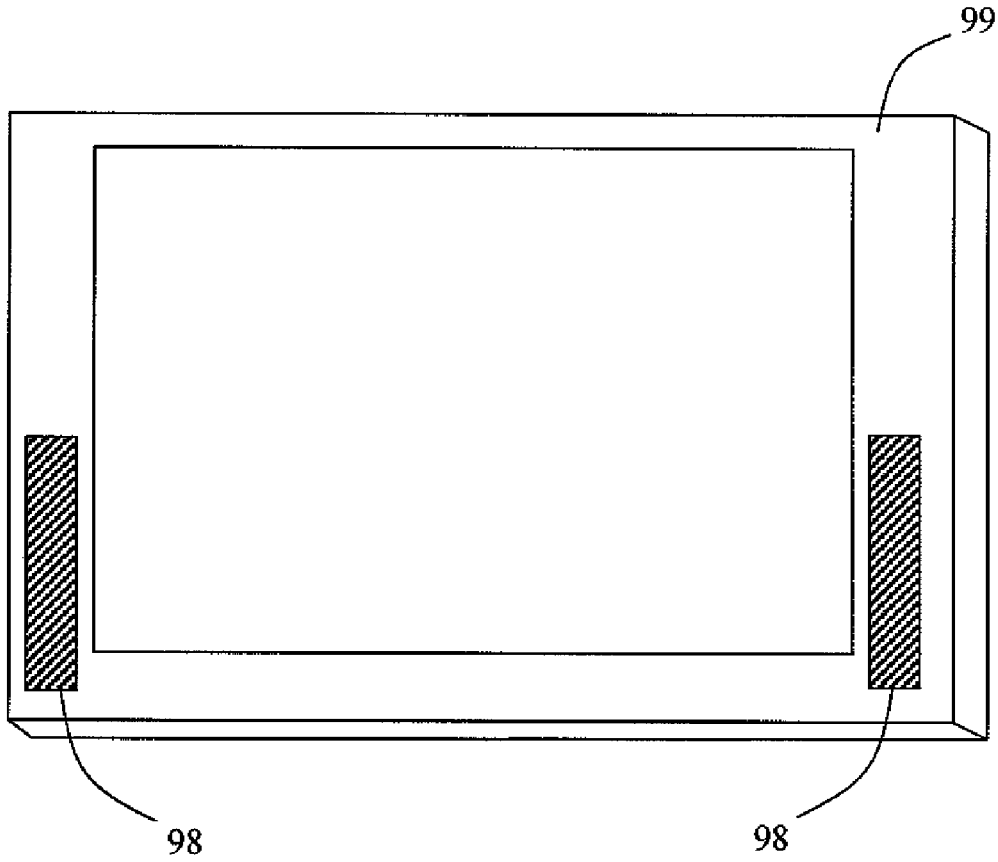
FIG. 33 is a diagram showing another exemplary flat-screen television 99 in which the speaker systems 98 are mounted.
Figure 34:
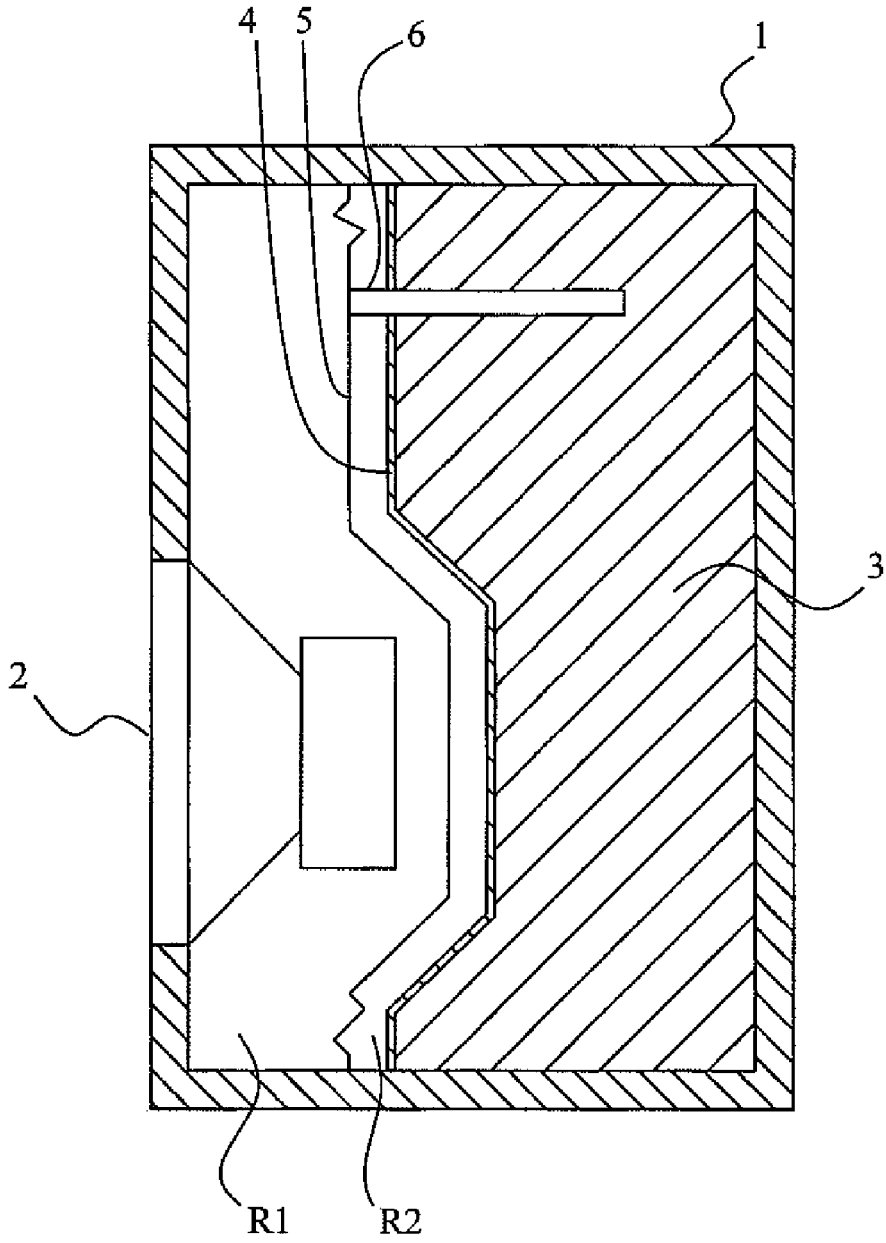
FIG. 34 PRIOR ART
FIG. 34 is a tectonic profile of a conventional speaker system disclosed in Japanese National Phase PCT Laid-Open Publication No. 60-500645.

In FIG. 32, two speaker systems 98 are situated inside the lower housing of the flat-screen television 99. Alternatively, only one speaker system 99 may be situated. Further, the speaker systems 98 may be situated inside the housings on the left and right, respectively, of the flat-screen television 99. FIG. 33 is a diagram showing another exemplary flat-screen television 99.

The above-described speaker system of the present invention is applicable to various apparatuses such as audio apparatuses and household electrical appliances other than the audio apparatuses.

While the invention has been described in detail, the foregoing description is in all aspects illustrative and not restrictive. It is understood that numerous other modifications and variations can be devised without departing from the scope of the invention.

What is claimed is:

1. A speaker system comprising:

a cabinet;

at least one speaker unit fixed to the cabinet;

a gas adsorbent which is situated inside the cabinet and which is made from a porous material; and at least one drone cone fixed to the cabinet, wherein the speaker unit includes moisture-proof component parts, the drone cone includes at least one diaphragm comprising a moisture-impermeable member, the diaphragm of the drone cone has provided therein a tubular structure which has a tubular hollow for allowing ventilation between an inside and an outside of the cabinet, and a resonant frequency which is determined by an acoustic impedance of the tubular structure and an acoustic impedance of the cabinet is lower than a minimum resonant frequency of an acoustic impedance of the speaker system.

2. The speaker system according to, claim 1, wherein the drone cone includes:

a first diaphragm which is made from a moisture-impermeable material, and which has a first through-hole;

an edge which is made from a moisture-impermeable material, which has a second through-hole having narrow openings, and which is fixed to the first diaphragm such that the first through-hole is connected to one extremity of the second through-hole and covers one of the openings of the second through-hole; and a second diaphragm which is made from a moisture-impermeable material, which has a third through-hole, and which is fixed to the edge such that the third through-hole is connected to another extremity of the second through-hole and covers another of the openings of the second through-hole, and the tubular hollow is formed by the first, second, and third through-holes.

3. The speaker system according to claim 1, further comprising a moisture absorbent material which is provided in a vicinity of the tubular hollow so as to absorb moisture.

4. The speaker system according to claim 1, wherein the cabinet includes a divider for dividing an internal cavity of the cabinet into a first cavity and a second cavity, the drone cone is fixed to the divider, the cabinet includes a port for acoustically connecting the first cavity to the outside of the cabinet, the speaker unit is fixed to the cabinet such that the speaker unit at least partially located within the first cavity, the gas adsorbent is situated inside the second cavity, and the tubular structure has the tubular hollow for allowing ventilation between the second cavity and the outside of the cabinet.

5. A portable terminal apparatus comprising:

the speaker system according to claim 1; and a housing accommodating the speaker system thereinside.

6. An audio-visual apparatus comprising:

the speaker system according to claim 1; and a housing accommodating the speaker system thereinside.

7. A vehicle comprising:

the speaker system according to claim 1; and a vehicle body accommodating the speaker system thereinside.

* * * * *